US010707552B2

(12) United States Patent
Harless

(10) Patent No.: US 10,707,552 B2
(45) Date of Patent: Jul. 7, 2020

(54) FOLDED RIB TRUSS STRUCTURE FOR REFLECTOR ANTENNA WITH ZERO OVER STRETCH

(71) Applicant: Eagle Technology, LLC, Melbourne, FL (US)

(72) Inventor: Richard I. Harless, Melbourne, FL (US)

(73) Assignee: Eagle Technology, LLC, Melbourne, FL (US)

( * ) Notice: Subject to any disclaimer, the term of this patent is extended or adjusted under 35 U.S.C. 154(b) by 164 days.

(21) Appl. No.: 16/107,853

(22) Filed: Aug. 21, 2018

(65) Prior Publication Data

US 2020/0067168 A1 Feb. 27, 2020

(51) Int. Cl.

| | |
|---|---|
| ***H01Q 15/20*** | (2006.01) |
| ***H01Q 1/12*** | (2006.01) |
| ***E04B 1/19*** | (2006.01) |
| ***H01Q 1/08*** | (2006.01) |
| ***H01Q 15/16*** | (2006.01) |

(52) U.S. Cl.

CPC ..... *H01Q 1/1235* (2013.01); *E04B 1/19* (2013.01); *H01Q 1/08* (2013.01); *H01Q 15/161* (2013.01)

(58) Field of Classification Search

CPC ..... H01Q 1/1235; H01Q 1/08; H01Q 15/161; H01Q 1/288; E04B 1/19

See application file for complete search history.

(56) References Cited

U.S. PATENT DOCUMENTS

| | | | |
|---|---|---|---|
| 4,030,102 | A | 6/1977 | Kaplan et al. |
| 4,989,015 | A | 1/1991 | Chang |
| 5,579,021 | A | 11/1996 | Lee |
| 5,666,128 | A | 9/1997 | Murray et al. |
| 5,714,179 | A | 2/1998 | Goodridge et al. |
| 5,818,395 | A | 10/1998 | Wolcott et al. |
| 5,864,324 | A | 1/1999 | Acker et al. |

(Continued)

FOREIGN PATENT DOCUMENTS

| | | | |
|---|---|---|---|
| CN | 102904001 | A | 1/2013 |
| EP | 0807991 | A1 | 11/1997 |
| JP | 2004-146898 | A | 5/2004 |

OTHER PUBLICATIONS

Extended European Search Report dated Oct. 4, 2019, Application Serial No. EP19192249.1 in the name of Eagle Technology, LLC.

*Primary Examiner* — Dieu Hien T Duong

(74) *Attorney, Agent, or Firm* — Fox Rothschild LLP; Robert J. Sacco; Carol E. Thorstad-Forsyth

(57) ABSTRACT

A foldable and expandable antenna reflector, and method of making and using the same are disclosed. The antenna reflector includes a reflector and a support structure where the support structure includes a hub assembly; a hub tower extending from the hub assembly; a plurality of drive strut assemblies that are connected to the hub assembly; and a plurality of rib assemblies connected to the hub tower and to the plurality of drive strut assemblies. Each rib assembly has a multi-piece rib hinge assembly so that each drive strut assembly is pivotably connected to one of the rib hinge assemblies and applies a force to expand the rib assembly in response to the hub assembly applying a force to at least one of the drive strut assemblies to thereby fold or expand the antenna reflector from a first folded configuration to a second expanded configuration.

25 Claims, 16 Drawing Sheets

(56) References Cited

U.S. PATENT DOCUMENTS 5,870,060 A 2/1999 Chen et al.
5,912,741 A 6/1999 Carter et al.
5,947,590 A 9/1999 Meuse et al.
5,969,695 A 10/1999 Bassily et al.
6,018,328 A 1/2000 Nolan et al.
6,028,570 A 2/2000 Gilger et al.
6,043,425 A 3/2000 Assad
6,081,244 A 6/2000 Peck
6,094,175 A 7/2000 Alessi et al.
6,104,358 A 8/2000 Parker et al.
6,133,570 A 10/2000 Schimert et al.
6,137,454 A 10/2000 Peck
6,154,522 A 11/2000 Cumings
6,172,655 B1 1/2001 Volman
6,189,835 B1 2/2001 Kaufman
6,191,757 B1 2/2001 Bassily et al.
6,208,317 B1 3/2001 Taylor et al.
6,214,144 B1 4/2001 Bassily et al.
6,219,003 B1 4/2001 Chandler
6,243,053 B1 6/2001 Shtarkman
6,278,416 B1 8/2001 Harless
6,285,332 B1 9/2001 Chandler
6,290,180 B1 9/2001 Browall et al.
6,297,511 B1 10/2001 Syllaios et al.
6,307,194 B1 10/2001 Fitzgibbons et al.
6,313,811 B1 11/2001 Harless
6,366,257 B1 4/2002 Ramanujam et al.
6,377,183 B1 4/2002 Baker et al.
6,445,343 B1 9/2002 Pietrusiak
6,489,929 B1 12/2002 Duchesne et al.
6,515,636 B2 2/2003 Munder et al.
6,542,129 B1 4/2003 Bien et al.
6,542,132 B2 4/2003 Stern
6,570,528 B1 5/2003 Rao et al.
6,608,607 B2 8/2003 Wu
6,611,238 B1 8/2003 Santoru et al.
6,618,025 B2 9/2003 Harless
6,621,459 B2 9/2003 Webb et al.
6,621,461 B1 9/2003 Ramanujam et al.
6,642,905 B2 11/2003 Bien et al.
6,747,608 B2 6/2004 Wu
6,768,468 B2 7/2004 Crouch et al.
6,775,046 B2 8/2004 Hill et al.
6,859,188 B1 2/2005 Matthews et al.
6,882,323 B2 4/2005 Peebles et al.
6,919,863 B2 7/2005 Kawahara et al.
6,930,654 B2 8/2005 Schmid et al.
6,937,203 B2 8/2005 Rao et al.
6,975,282 B2 12/2005 Kaufman et al.
7,009,578 B2 3/2006 Nolan et al.
7,024,158 B2 4/2006 Wiswell
7,034,771 B2 4/2006 Rao et al.
7,104,506 B1 9/2006 Goodzeit et al.
7,110,716 B2 9/2006 Rao et al.
7,119,480 B2 10/2006 Guy
7,126,477 B2 10/2006 Gallivan et al.
7,129,903 B2 10/2006 Desargant et al.
7,216,995 B2 5/2007 Harada et al.
7,242,904 B2 7/2007 Rao et al.
7,270,301 B2 9/2007 Maurel
7,345,653 B2 3/2008 Nolan et al.
7,379,191 B2 5/2008 Brooks
7,382,743 B1 6/2008 Rao et al.
7,394,436 B2 7/2008 Rao et al.
7,443,573 B2 10/2008 Brown
7,490,538 B2 2/2009 Lowell et al.
7,494,255 B2 2/2009 Bryan et al.
7,498,549 B2 3/2009 Gallivan et al.
7,570,226 B2 8/2009 Bassily
7,595,769 B2 9/2009 Bassily
7,675,456 B2 3/2010 Karam
7,686,255 B2 3/2010 Harris
7,705,796 B2 4/2010 Park
7,710,340 B2 5/2010 Rao et al.
7,714,792 B2 5/2010 Leveque et al.
7,715,091 B2 5/2010 Brown
7,721,426 B2 5/2010 Desagulier et al.
7,726,015 B2 6/2010 Desagulier et al.
7,730,819 B2 6/2010 Lowell et al.
7,737,903 B1 6/2010 Rao et al.
7,751,779 B2 7/2010 Ho et al.
7,784,390 B1 8/2010 Lowell et al.
7,804,055 B2 9/2010 Backes
7,839,353 B2 11/2010 Bassily
7,868,840 B2 1/2011 Rao et al.
7,920,100 B2 4/2011 Brown
8,253,620 B2 8/2012 Wise et al.
8,269,202 B2 9/2012 Backes
8,315,557 B1 11/2012 Rao et al.
8,317,960 B2 11/2012 Montesano Benito et al.
8,354,956 B2 1/2013 Matyas et al.
8,462,067 B2 6/2013 Maxwell-Cox
8,481,858 B2 7/2013 Desagulier
8,508,430 B2 * 8/2013 Palmer ..... H01Q 15/161 343/881
8,568,100 B2 10/2013 Muylaert et al.
8,587,227 B2 11/2013 Koch
8,659,493 B2 2/2014 Bosshard et al.
8,760,358 B2 6/2014 Bouguereau et al.
8,781,794 B2 7/2014 Harrison et al.
8,797,663 B1 8/2014 Bouckaert
8,810,806 B2 8/2014 Barbier et al.
8,878,745 B2 11/2014 Navarre et al.
8,905,587 B1 12/2014 Bouckaert
8,960,929 B2 2/2015 Devilliers et al.
9,099,595 B2 8/2015 King et al.
9,112,281 B2 8/2015 Bresciani et al.
9,190,716 B2 11/2015 Robson et al.
9,281,569 B2 3/2016 Taylor et al.
9,293,820 B2 3/2016 Koduru et al.
9,318,808 B1 4/2016 Weaver et al.
9,337,544 B2 5/2016 Theunissen et al.
9,381,581 B1 7/2016 Zaman et al.
9,429,300 B2 8/2016 Bouckaert
9,458,987 B2 10/2016 Jungwirth et al.
9,484,636 B2 11/2016 Mobrem
9,496,621 B2 11/2016 Meschini et al.
9,608,333 B1 3/2017 Toledo et al.
10,236,590 B1 * 3/2019 Footdale ..... H01Q 15/162

* cited by examiner

FOLDED RIB TRUSS STRUCTURE FOR REFLECTOR ANTENNA WITH ZERO OVER STRETCH

FIELD OF THE INVENTION

The present invention relates to antennas or reflectors for terrestrial or space applications and in an embodiment relates to a new and improved foldable antenna or reflector that is lightweight and highly reflective.

BACKGROUND OF THE INVENTION

The use of antenna reflectors for satellite communication networks is becoming more widespread as the demand for mobile communications increases. One type of a reflector or antenna is fixed reflectors where the satellite's operational surface is constructed, transported into space via satellite, and deployed in space, all in a fixed geometric configuration. These fixed surface reflectors may have a solid surface or a mesh surface. The fixed surface reflectors are in circumstances disadvantageous because they take up a lot of space during transit and may be difficult to deploy, particularly if a large reflector is required. The other type of reflectors is expandable reflectors in the sense that they fold up into a compact form for transport into space, and are deployed in space where they are unfolded and expanded to larger dimensions. The disadvantage of these expandable type reflectors is that given the cost of transporting them into space they have to reliably unfold and expand into an accurate geometric shape to be effective. If the reflector antenna does not expand into the correct and accurate shape, then the antenna may be ineffective or unuseable for its intended purpose at great expense, and the cost and delay to replace the reflector antenna will be large.

The present invention in one or more embodiments and aspects preferably overcomes, alleviates, or at least reduces some of the disadvantages of the prior fixed surface and/or expandable antenna reflectors.

SUMMARY OF THE INVENTION

The summary of the disclosure is given to aid understanding of a reflector, reflector structure, reflector support structure, reflector system, and method of manufacturing and deploying the same, and not with an intent to limit the disclosure or the invention. The present disclosure is directed to a person of ordinary skill in the art. It should be understood that various aspects and features of the disclosure may advantageously be used separately in some instances, or in combination with other aspects and features of the disclosure in other instances. Accordingly, variations and modifications may be made to the reflector, reflector system, reflector structure, reflector support structure, or its method of manufacture and operation to achieve different effects.

Certain aspects of the present disclosure provide a reflector, a reflector structure, a reflector support structure, a reflector system, and/or a method of manufacturing, deploying and using a reflector, a reflector structure, a reflector support structure, and a reflector system, preferably a foldable and expandable reflector and reflector system. In an embodiment, the reflector, reflector structure, reflector support structure, and or reflector system has superior reliability and preferably will not overstress the structural elements of the reflector.

In an embodiment a foldable and expandable antenna reflector support structure to support an expandable generally dish shaped reflector is disclosed. The reflector support structure in an aspect includes a hub assembly to provide a force to the support structure; a hub tower extending from the hub assembly; a plurality of drive strut assemblies; and a plurality of rib assemblies. Each drive strut assembly in an embodiment has an inner drive strut, an outer drive strut and a strut hinge assembly so that the inner drive strut can pivot or rotate with respect to the outer drive strut so that each drive strut assembly can fold or expand, and at least one drive strut assembly is, preferably all drive strut assemblies are, connected to the hub assembly and is/are configurable to receive a force from the hub assembly. Each rib assembly in an embodiment has an inner rib, an outer rib, and a multi-piece rib hinge assembly so that the inner rib can pivot or rotate with respect to the outer rib, and each inner rib preferably is pivotably connected to the hub tower. In a further aspect, the support structure has a first folded configuration and a second expanded configuration and each drive strut assembly is pivotably connected to one of the rib assemblies and is configured to apply a force to that rib assembly to rotate the outer rib with respect to the inner rib in response to the hub assembly applying the force to the at least one of the drive strut assemblies to thereby fold or expand the reflector support structure from the first folded configuration to the second expanded configuration.

In an embodiment, the rib hinge assembly comprises an inner rib fitting, an outer rib fitting and an outer drive strut fitting. The outer drive strut fitting in an aspect has a plurality of articulating connections; the inner rib fitting in an aspect has three articulation connections; and the outer rib fitting has a plurality of articulating connections. The rib hinge assembly in an embodiment includes six components with seven articulating connections. In a further embodiment, the rib hinge assembly includes additional intermediate elements and the outer drive strut fitting connects to the inner rib fitting and the additional intermediate elements. The additional intermediate elements preferably include three structural elements, and in an aspect the additional intermediate members includes a frame with three articulating connections, and in a further aspect the additional intermediate members includes two link elements, preferably linear links, each with two articulating connections.

The reflector support structure optionally further includes at least one deployable standoff (DPSO). The support structure preferably optionally includes a cable system to restrain the reflector support structure. The hub assembly in an embodiment includes a carrier, a pull rod and a pivot link. The hub assembly may further include a screw, and a motor for rotating the screw. In an embodiment, the inner drive strut rotates approximately 180 degrees with respect to the outer drive strut and in response the outer rib rotates approximately 180 degrees with respect to the inner rib. Other rotational ranges are contemplated for the drive strut assemblies and/or the rib assemblies.

In another aspect, an antenna reflector system is disclosed. The antenna reflector includes in an embodiment a reflector; and a support structure where the support structure includes a multi-component hub assembly configured to provide a force to the support structure; a hub tower extending from the hub assembly and including a pivot ring; a plurality of drive strut assemblies; and a plurality of rib assemblies. Each drive strut assembly in an embodiment includes an inner drive strut, a drive strut hinge assembly, and an outer drive strut, wherein the inner drive strut is pivotably connected to the outer drive strut by the drive strut hinge assembly, and each inner drive strut is connected to the hub assembly. Each rib assembly in an embodiment includes an inner rib, an outer rib and a rib hinge assembly, wherein the inner rib of each rib assembly is pivotably connected to the pivot ring and each rib hinge assembly comprises multiple pieces and the rib hinge assembly has seven articulating connections. In an aspect, the hub assembly rotates the inner drive strut which in response rotates the outer drive strut which in response applies a force to the rib hinge assembly which in response rotates the outer rib with respect to the inner rib which expands or collapses the support structure and the reflector.

In an embodiment, the reflector preferably includes a mesh surface formed of conductive filaments with openings. In an embodiment, the rib hinge assembly preferably has an inner rib fitting at the end of the inner rib having three articulating connections, an outer rib fitting at the end of the outer rib having two articulating connections, and an outer drive strut fitting at the end of the outer drive strut having two articulating connections, wherein at least one of the articulating connections of the outer drive strut fitting is connected to at least one of the articulating connections of the inner rib fitting. The rib hinge assembly in a preferred aspect further includes a frame having three articulating connections, and two hinge links, preferably straight inner and outer hinge links, each having two articulating connections, wherein the frame has one articulating connection connected to the inner rib fitting and one articulating connection connected to the outer rib fitting. In an aspect, one of the hinge links, e.g., the outer hinge link, connects to both the outer rib fitting and the inner rib fitting, and the other of the hinge links, e.g., the inner hinge link, is connected to both the frame and the outer drive strut fitting.

The antenna reflector optionally has a cable system to restrain expansion of the support structure. The cable system in an embodiment has a tower cord, preferably a plurality of tower cords equal to the number of rib assemblies, that extends from the hub assembly to the outer rib of the rib assembly. The cable system can further include in an embodiment a cross cable, preferably a plurality of cross cables, that extends from the outer rib of a first rib assembly to the hinge assembly of a second adjacent rib assembly. In yet a further embodiment, the cable system further includes at least one, preferably a plurality of, hinge hoop cables wherein the hinge hoop cable extends from the rib assembly to an adjacent rib assembly, and preferably a hinge hoop cable extends from each rib hinge assembly to each adjacent rib hinge assembly.

A preferred embodiment of an antenna reflector system is also disclosed. The preferred antenna reflector system in an embodiment includes a mesh reflector; and a support structure, the support structure having a hub assembly, a hub tower, a plurality of drive strut assemblies, and a plurality of rib assemblies. In an embodiment, the hub assembly has a rotatable screw, a carrier mounted on and translatable with respect to the screw, a plurality of pull rods pivotably connected to the carrier, with each pull rod pivotably connected to a pivot link. The hub tower in an aspect extends from the hub assembly and includes a pivot ring. In an embodiment, each drive strut assembly comprising an inner drive strut, a drive strut hinge assembly, and an outer drive strut, wherein the inner drive strut is pivotably connected to the outer drive strut by the drive strut hinge assembly, and each inner drive strut is connected to the pivot link of the hub assembly. Each rib assembly preferably includes an inner rib, an outer rib, and a rib hinge assembly, wherein each rib hinge assembly comprises multiple pieces and the rib hinge assembly has seven articulating connections, and the inner rib of each rib assembly is pivotably connected to the pivot ring. The rib hinge assembly in an embodiment includes an outer drive strut fitting connected to the outer drive strut, and the outer drive strut fitting having two of the articulating connections. The multi-piece rib hinge assembly in an aspect further includes an inner rib fitting, an inner hinge link, a frame, an outer hinge link, and an outer rib fitting. The pivot link of the hub assembly in an aspect rotates the inner drive strut which in response rotates the outer drive strut which in response applies a force to the rib hinge assembly which in response rotates the outer rib with respect to the inner rib which expands or collapses the antenna reflector.

BRIEF DESCRIPTION OF THE DRAWINGS

The various aspects, features and embodiments of the reflector, reflector system, reflector structure, reflector support structure, and their method of manufacture and operation will be better understood when read in conjunction with the figures provided. Embodiments are provided in the figures for the purpose of illustrating aspects, features and/or various embodiments of the reflector, reflector structure, reflector support structure, reflector system, and their method of manufacture and operation, but the claims should not be limited to the precise arrangement, structures, features, aspects, embodiments or devices shown, and the arrangements, structures, subassemblies, features, aspects, methods, processes, embodiments, methods, and devices shown may be used singularly or in combination with other arrangements, structures, subassemblies, features, aspects, embodiments, methods and devices. The drawings are not necessarily to scale and are not in any way intended to limit the scope of the claims, but are merely presented to illustrate and describe various embodiments, aspects and features of the reflector, reflector structure, reflector support structure, reflector system, and/or their method of manufacture and operation to one of ordinary skill in the art.

DETAILED DESCRIPTION

Figure 1:
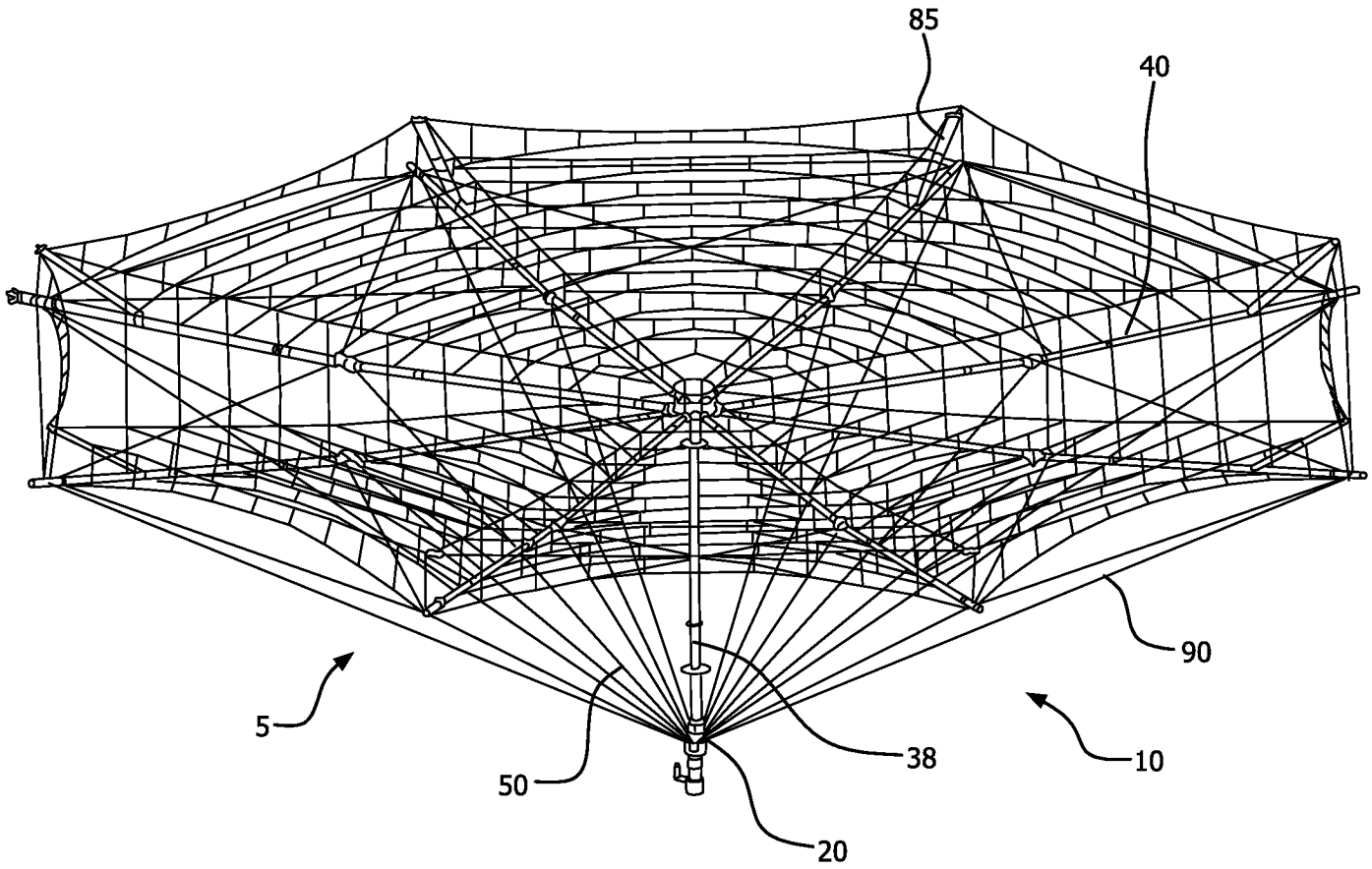
FIG. 1 is a top perspective view of a foldable antenna reflector support structure according to an embodiment of the disclosure in a fully expanded configuration or position.

The following description is made for illustrating the general principles of the invention and is not meant to limit the inventive concepts claimed herein. In the following detailed description, numerous details are set forth in order to provide an understanding of a reflector, a reflector structure, a reflector support structure, a reflector system, and their method of manufacture and operation, however, it will be understood by those skilled in the art that different and numerous embodiments of the reflector, reflector structure, reflector support structure, reflector system, and their method of manufacture and operation may be practiced without those specific details, and the claims and invention should not be limited to the embodiments, subassemblies, features, processes, methods, aspects, features or details specifically described and shown herein. Further, particular features described herein can be used in combination with other described features in each of the various possible combinations and permutations.

Accordingly, it will be readily understood that the components, aspects, features, elements, and subassemblies of the embodiments, as generally described and illustrated in the figures herein, can be arranged and designed in a variety of different configurations in addition to the described embodiments. It is to be understood that the reflector, reflector structure, reflector support structure, and reflector system may be used with many additions, substitutions, or modifications of form, structure, arrangement, proportions, materials, and components which may be particularly adapted to specific environments and operative requirements without departing from the spirit and scope of the invention. The following descriptions are intended only by way of example, and simply illustrate certain selected embodiments of a reflector, a reflector structure, a reflector support structure, a reflector system, and their method of manufacture and operation. For example, while the reflector is shown and described in examples with particular reference to its use as a satellite antenna, it should be understood that the reflector, reflector structure, reflector support structure, and reflector system may have other applications as well. Additionally, while the reflector and reflector structure is shown and described as a mesh reflector, it should be understood that the reflector and reflector structure may have application to solid surface reflectors as well. The claims appended hereto will set forth the claimed invention and should be broadly construed to cover reflectors, reflector structures, deployable reflectors, reflector support structures, and/or reflector systems, and their method of manufacture and operation, unless otherwise clearly indicated to be more narrowly construed to exclude embodiments, elements and/or features of the reflector, reflector system and/or their method of manufacture and operation.

It should be appreciated that any particular nomenclature herein is used merely for convenience, and thus the invention should not be limited to use solely in any specific application identified and/or implied by such nomenclature, or any specific structure identified and/or implied by such nomenclature. Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and the terms "comprises" and/or "comprising" specify the presence of the stated features, integers, steps, operations, elements and/or components, but do not preclude the presence or addition of one or more other features, integers, steps, operations, elements, components, and/or groups thereof.

In the following description of various embodiments of the reflector, reflector structure, reflector support structure, reflector system, and/or method of manufacture and operation, it will be appreciated that all directional references (e.g., upper, lower, upward, downward, left, right, lateral, longitudinal, front, rear, back, top, bottom, above, below, vertical, horizontal, radial, axial, interior, exterior, clockwise, and counterclockwise) are only used for identification purposes to aid the reader's understanding of the present disclosure unless indicated otherwise in the claims, and do not create limitations, particularly as to the position, orientation, or use in this disclosure. Features described with respect to one embodiment typically may be applied to another embodiment, whether or not explicitly indicated.

Connection references (e.g., attached, coupled, connected, and joined) are to be construed broadly and may include intermediate members between a collection of elements and relative movement between elements unless otherwise indicated. As such, connection references do not necessarily infer that two elements are directly connected and/or in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary and may not be to scale.

The following discussion omits or only briefly describes conventional features of reflectors, including deployable reflectors, reflector structures, reflector support structures, and reflector systems, which are apparent to those skilled in the art. It is assumed that those skilled in the art are familiar with the general structure, operation and manufacturing techniques of reflectors, and in particular collapsible reflectors. It may be noted that a numbered element is numbered according to the figure in which the element is introduced, and is typically referred to by that number throughout succeeding figures.

Disclosed is an expandable and foldable antenna reflector. In an embodiment, the expandable and foldable antenna reflector 5 includes a reflector 7 (see FIG. 6) having a surface 15, preferably a mesh reflector surface, and a support structure 10 as shown in FIG. 1. The reflector preferably is shaped like a parabola and preferably has a highly accurate surface. The reflector preferably in an embodiment is a mesh reflector. The reflector is supported by, and in preferred embodiments connected to, foldable support structure 10, an embodiment of which is shown in FIG. 1. The surface 15 of the reflector 7 (shown in FIG. 6) in a preferred embodiment is formed of a mesh material 12 (see FIG. 6). The reflector 7 in an embodiment may include a plurality, e.g., two, stacked web layers. Each layer of open mesh is formed of highly conductive filaments which define openings. The mesh 12 can be designed and configured as disclosed in U.S. Pat. No. 8,654,033, the entire contents of which are incorporated by reference. Other mesh designs, configurations, and surface geometrics and shapes are contemplated for the disclosed reflector.

Figure 2:
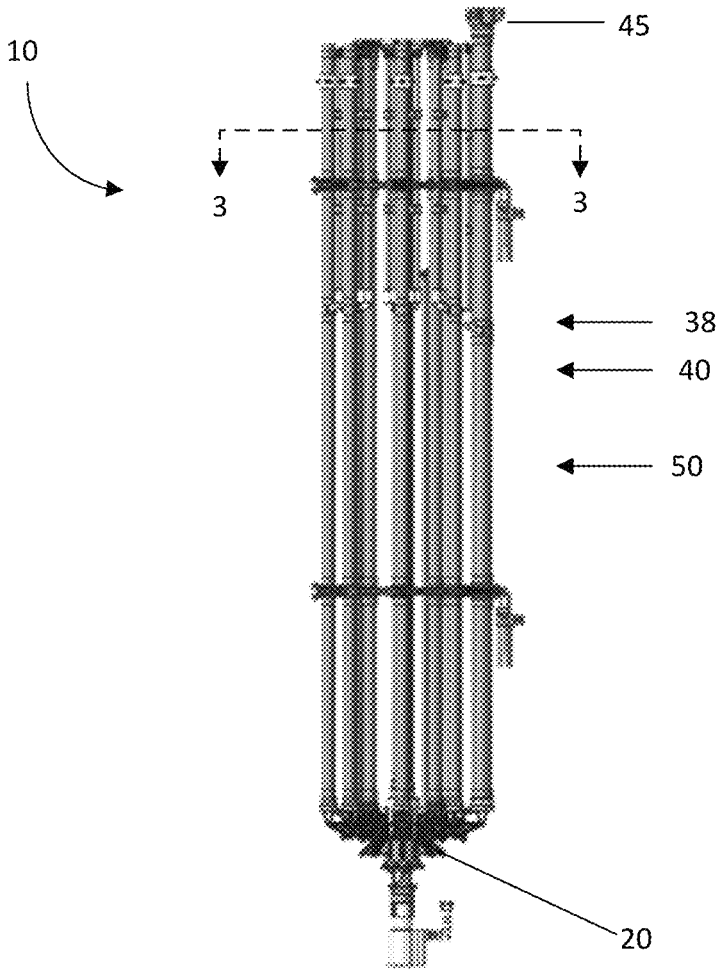
FIG. 2 is a side view of a reflector support structure according to an embodiment of the disclosure in a fully collapsed or folded configuration or position.
Figure 3:
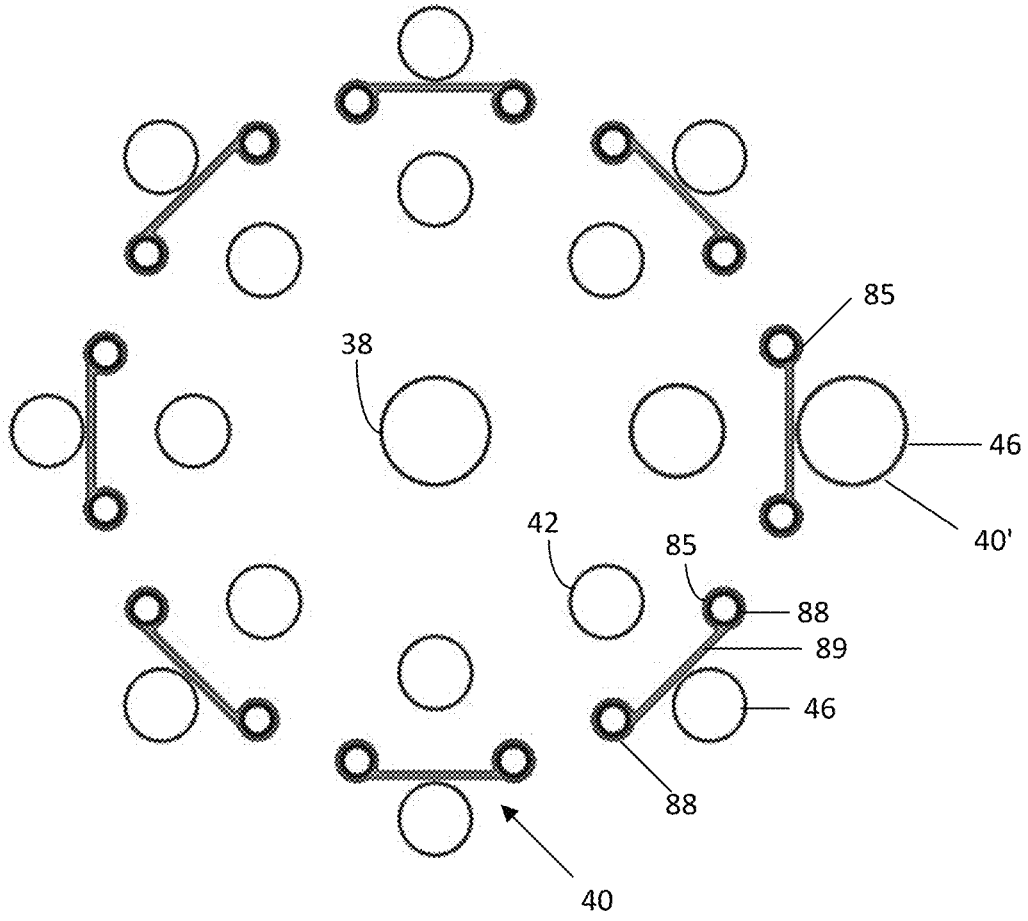
FIG. 3 is cross-sectional view of the reflector support structure of FIG. 2 taken along section 3-3.
Figure 4:
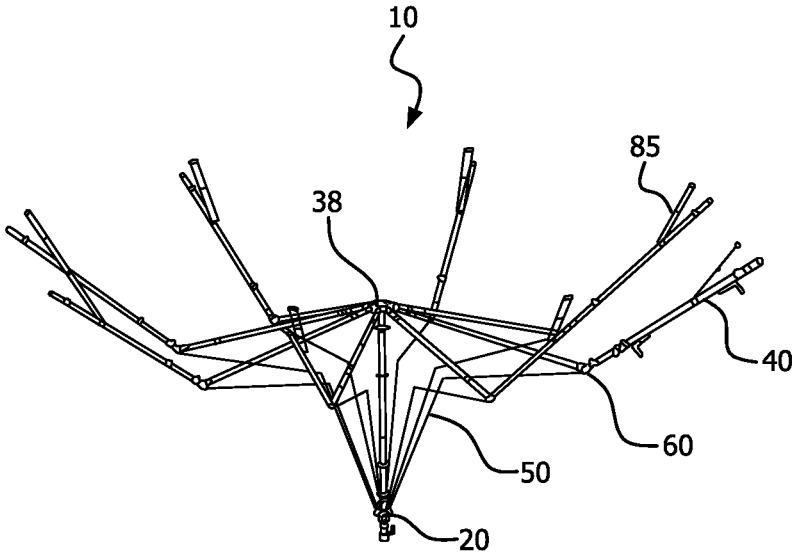
FIG. 4 is a side perspective view of an embodiment of the reflector support structure of FIG. 2 in its partially unfolded configuration or position as it unfolds during deployment.
Figure 5:
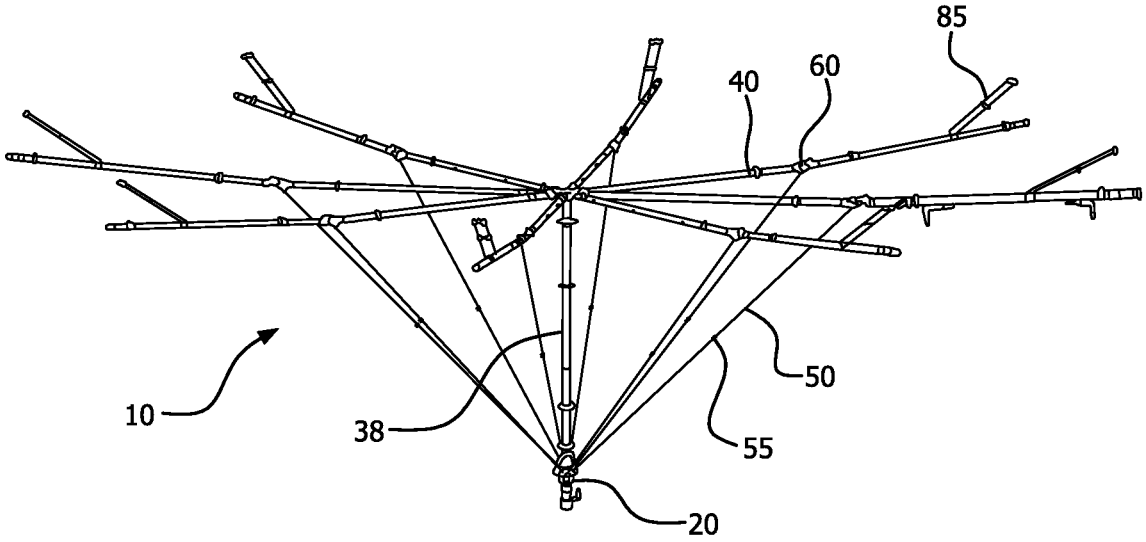
FIG. 5 is a side perspective view of an embodiment of the reflector support structure of FIG. 2 in the fully deployed position.
Figure 6:
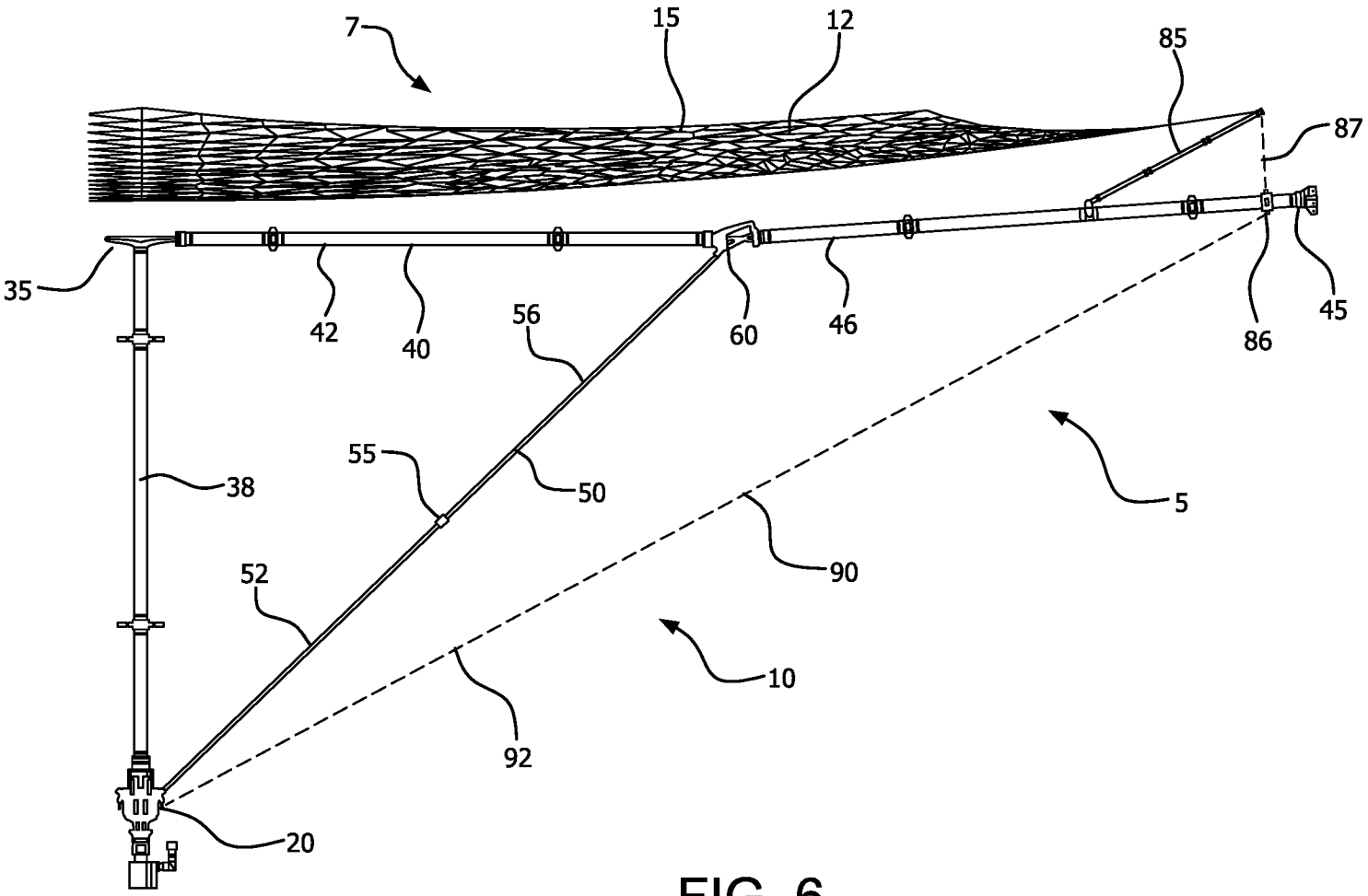
FIG. 6 is a side view of a portion of the reflector support structure of FIG. 5 with a portion of an embodiment of the reflector surface.
Figure 25:
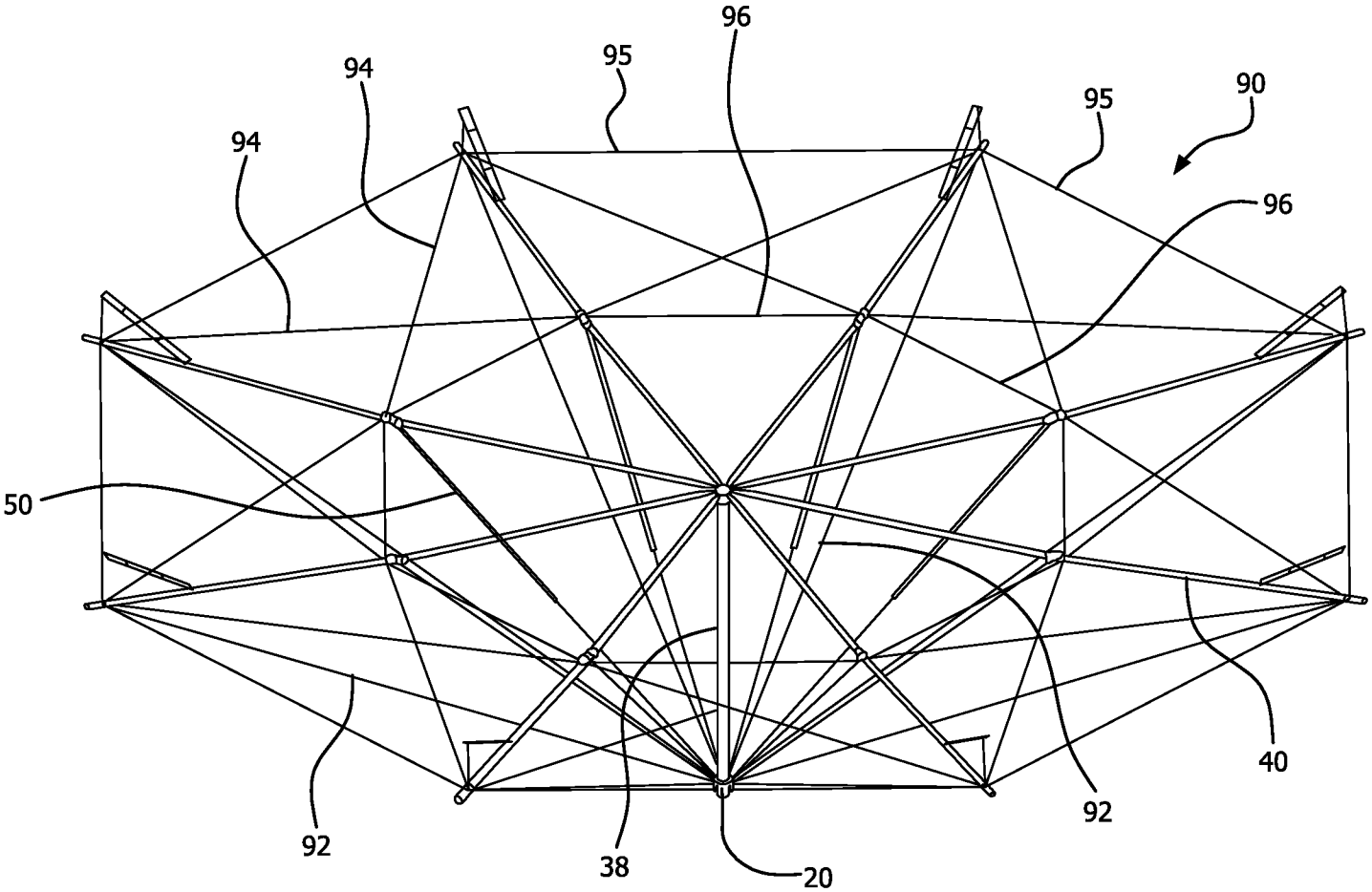
FIG. 25 is a top perspective view of an embodiment of a support structure with cable system for a reflector structure.

FIGS. 1-6 and FIG. 25 show an embodiment of a support structure 10 for an antenna reflector. FIG. 1 shows an embodiment of support structure 10 of the reflector antenna in a fully expanded configuration with an embodiment of a cable system for the reflector and the support structure. FIG. 2 shows an embodiment of a support structure 10 of the reflector antenna 5 in a fully folded configuration, FIG. 3 shows a cross section of the support structure 10 taken at Section 3-3 of FIG. 2, FIG. 4 shows the support structure 10 of the reflector antenna 5 in a partially expanded (or partially folded) configuration, and FIG. 5 shows the support structure 10 in the fully expanded configuration or position. FIG. 6 shows a side view of a portion of the support structure 10 and reflector 7, and reflector surface 15, in a fully expanded position. FIG. 25 shows a top perspective view of an embodiment of a reflector support structure 10.

As illustrated in FIGS. 1-6, support structure 10 in an embodiment includes a hub assembly 20, a hub tower 38, a plurality of rib assemblies 40, a plurality of drive strut assemblies 50, a plurality of optional deployable stand-off (DPSO) assemblies 85, and an optional cable system 90. In the embodiment illustrated in FIGS. 1-6 there are eight rib assemblies 40, eight drive strut assemblies 50, and eight DPSO assemblies 85. It is contemplated that more or less rib assemblies 40, drive strut assemblies and/or DPSO assemblies 85 may be utilized to form the support structure 10 for the reflector 7. To unfold the support structure 10 to deploy the antenna reflector 5, the hub assembly 20 applies a force to the support structure, and more specifically portions of the hub assembly apply a force to move, deploy, unfold and expand the drive strut assembly 50, and the drive strut assembly 50 in response applies a force on the rib hinge assembly 60 and/or the rib assembly 40 to unfold the rib assembly 40 to expand the foldable antenna reflector 5.

The hub assembly 20 connects to the hub tower 38 and the plurality of drive strut assemblies 50. More specifically, the hub tower 38 extends from one end of the hub assembly 20, and in an embodiment the hub assembly 20 preferably is fixedly-connected to the hub tower 38. The hub assembly 20 preferably is connected to, preferably pivotably connected to, each drive strut assembly 50. Each rib assembly 40 connects to the hub tower 38, one of the drive strut assemblies 50, and preferably one of the DPSO assemblies 85. A cable or cord system 90 optionally interconnects to one or more of the support structure elements and assemblies 10, e.g., rib assembly 40, hub assembly 20, and/or drive strut assembly 50.

Figure 7:
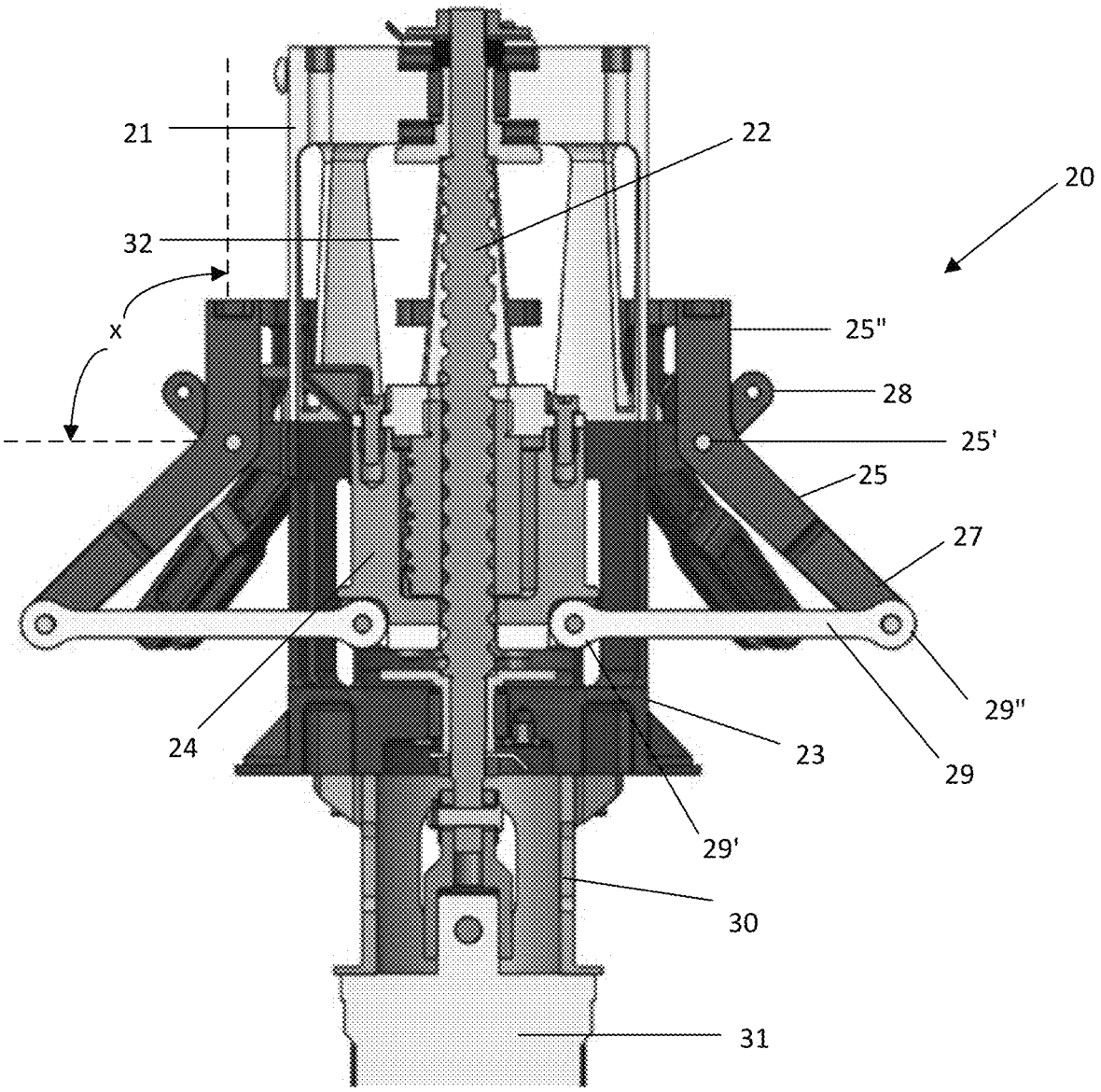
FIG. 7 is a cross-sectional view of an embodiment of a hub assembly of a foldable reflector in a first configuration or position.
Figure 8:
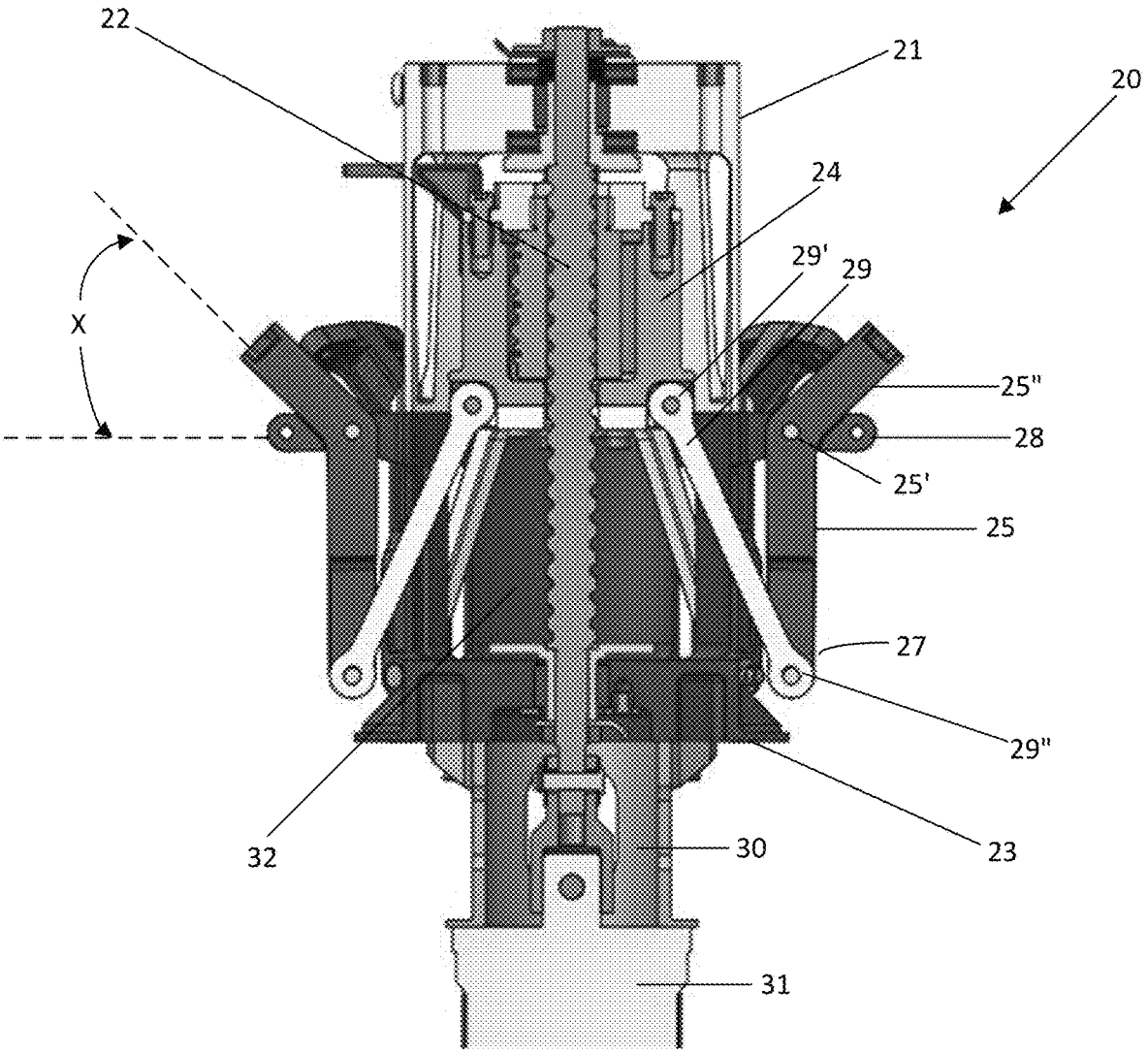
FIG. 8 is a cross-sectional view of an embodiment of a hub assembly of a foldable reflector in a second configuration or position.
Figure 9:
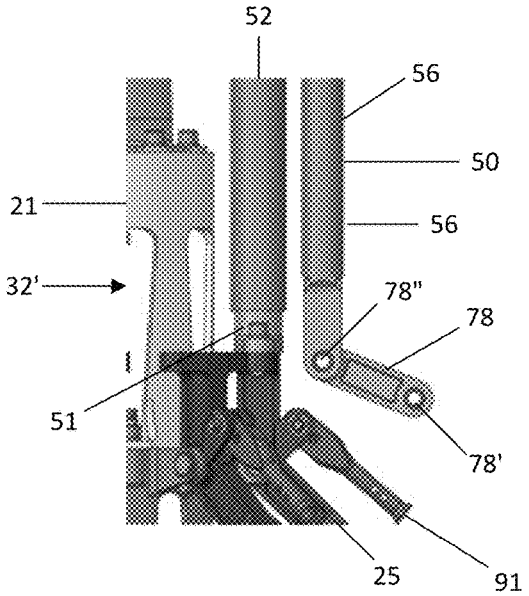
FIG. 9 is a side perspective view of a portion of the hub assembly and a portion of a drive strut assembly according to an embodiment of the disclosure.
Figure 10:
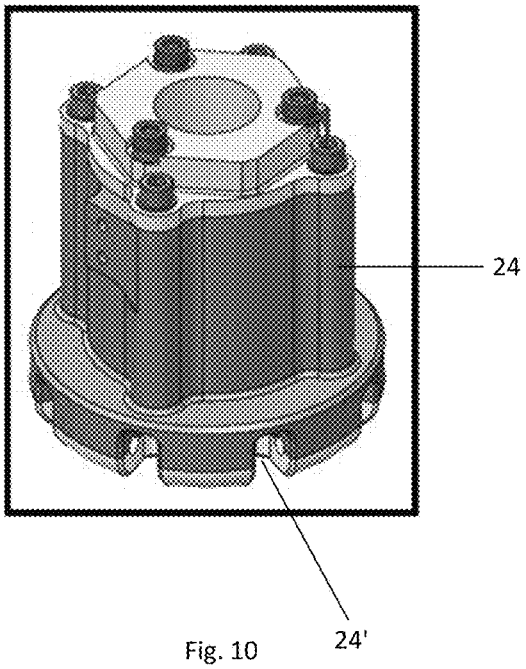
FIG. 10 is a perspective view of an embodiment of a carrier of a hub assembly.

Turning to the specifics of an embodiment of hub assembly 20 illustrated in FIGS. 6-11, hub assembly 20 includes an upper shell 21, a ball screw 22, a lower shell 23, a carrier 24, a pivot link 25, a pull rod 29, an optional motor adapter 30, and an optional motor 31. The upper shell 21 and lower shell 23 stabilize and hold ball screw 22 and together form a cavity 32 to receive carrier 24. The carrier 24, a side perspective view of which is shown in FIG. 10, is connected to end 29' of pull rod 29, preferably pivotably connected at articulating connection 24' to pull rod 29. Ball screw 22 has external threads and carrier 24 has internal threads, and in operation carrier 24 translates or moves along screw 22 and within cavity 32. Referring to FIGS. 7 and 8, movement or translation of carrier 24 moves pull rod 29, and more specifically laterally moves articulating connector 29' of pull rod 29, and pivots or rotates pull rod 29. The other articulating end 29" of pull rod 29 connects, preferably pivotably connects, to pivot link 25 at articulating connection 27. The pivoting connection of pull rod 29 to carrier 24 at articulating connection 24', and the pivoting connection of pull rod 29 to pivot link 25 at articulating connection end 27 of the pivot link 25 preferably uses a pin to connect the various members together while allowing articulating movement, rotation and or pivotable motion. While a pin connection is often used in the support structure 10 to connect two members together while permitting pivotable or rotational movement between two members, it is contemplated that other joint connection structures and assemblies may be used to pivotably connect two members together.

Figure 11:
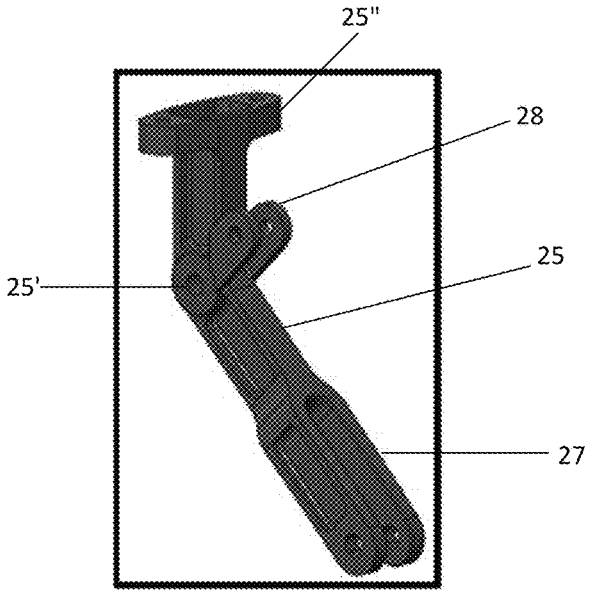
FIG. 11 is a side perspective view of an embodiment of a pivot link of a hub assembly.

Pivot link 25, as shown in FIGS. 8, 9, and 11, is an angulated member that has a mid-connection portion 25', a connection end 27, a projection connection portion 28, and drive strut connection end 25". Mid-connection portion 25' connects, preferably pivotably connects, to lower shell 23 by use of a pin. Movement of pull rod 29 pulls on connection end 27 of pivot link 25 to pivot or rotate pivot link 25 to unfold or fold support structure 10. In an embodiment, optional motor 31 is connected to screw 22 within the space provided by motor adapter 30. Optional motor 31 rotates screw 22 to move and translate carrier 24 within cavity 32, to apply a force to and move, e.g., rotate, pivot link 25.

FIGS. 7 and 9 illustrate the relative positions of the carrier 24, the pivot link 25, and the pull rod 29 when the reflector support structure (and reflector antenna) is in its folded (collapsed position), and FIG. 8 illustrates the carrier 24, pivot link 25, and pull rod 29 when the reflector support structure 10 is in the fully expanded (unfolded) position. The drive strut assembly 50 attaches to, preferably fixedly connects to, the pivot link 25, and extends from the pivot link 25 as shown in FIG. 9. The drive strut assembly 50 forms an angle x with a horizontal line through the hub assembly 20 as shown in FIGS. 7-8, where the angle x changes as the reflector antenna moves from its folded configuration or mode to its unfolded (expanded) configuration or mode. When the reflector antenna is fully folded, the angle x is substantially 90 degrees and the folded drive strut assembly 50 extends in a substantially vertical position, i.e., the drive strut assembly 50 extends upward along the upper shell 21 of the hub assembly 20 and along the hub tower 38. When in the fully expanded position as shown in FIG. 8, the angle x, in an embodiment, is about 45 degrees, preferably about 44 degrees, although other angles, geometric orientations, and ranges or angular motion of the pivot link 25 and drive strut assembly 50 with respect to the hub assembly 20 and hub tower 38 are contemplated.

Turning to more specifics regarding the operation of the hub assembly 20, as the ball screw 22 rotates, the carrier stop 24 rises toward and into the upper cavity portion 32' created and surrounded by upper shell 21, which pulls end 29' of the pull rod 29 up, which in response draws end 27 of the pivot link 25 in toward shell 23, which in turn rotates or pivots the pivot link 25 about mid-connection 25', so that it angulates from the first position shown in FIG. 7 to its second angular position shown in FIG. 8. The carrier 24 moving up along the ball screw 22 rotates or pivots the pivot link 25 on lower shell 23 of the hub assembly 20 to deploy, unfold and expand the drive strut assembly 50, and the drive strut assembly 50 in response applies a force on the rib hinge assembly 60 and/or the rib assembly 40 to unfold the rib assembly 40 to expand the foldable reflector 5.

Figure 12:
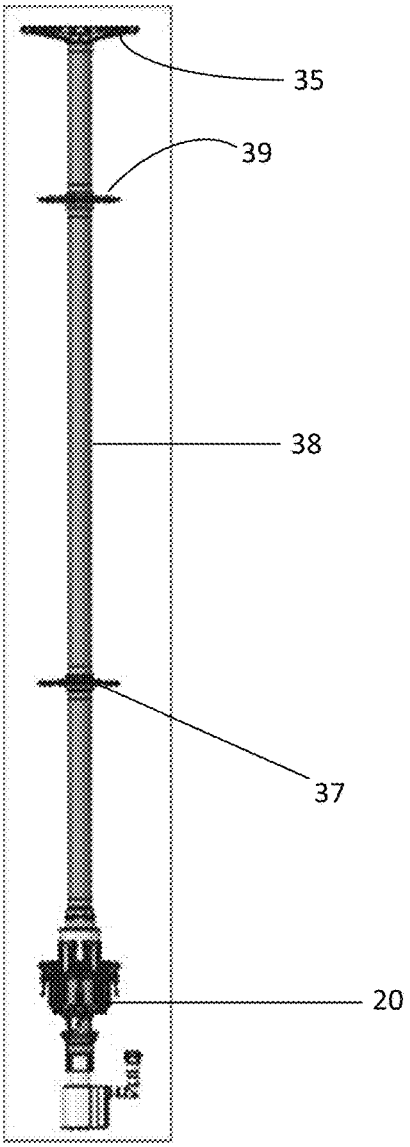
FIG. 12 is a side view of an embodiment of a hub assembly and hub tower.
Figure 13:
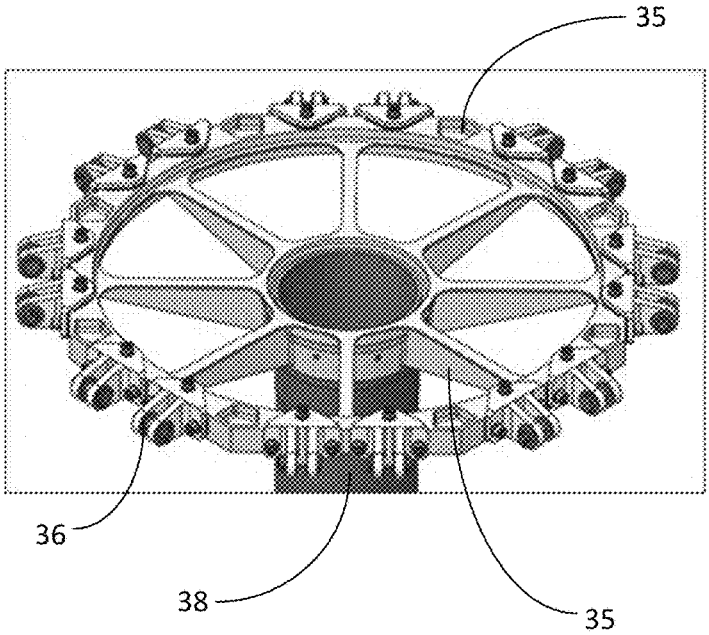
FIG. 13 is a top perspective view of an embodiment of a pivot ring at the end of a hub tower.

Hub tower 38 extends vertically upward from one end of hub assembly 20 as shown in FIG. 12. At the end of hub tower 38 away from hub assembly 20 is a pivot ring 35 illustrated in FIGS. 12 and 13. Pivot ring 35 has a plurality of connectors 36 to connect the rib assemblies 40 to the hub tower 38. The connectors 36 are preferably fixedly connected to the pivot ring 35. The connectors 36 are preferably articulating connectors that connect the rib assembly to the hub tower 38, and more specifically the pivot ring 35 in a manner to permit the rib assembly 40 to rotate and pivot with respect to the hub tower 38, and more specifically the pivot ring 35, so that the rib assembly 40 (explained in greater detail below) can unfold and expand. The hub tower 38 optionally has restraint plane brackets 37 and 39 that are small radial arms on the hub tower 38 that support the rib assembly 40 in the stored position. Optional pin pullers 33 (not shown) may interact with the restraint plane brackets 37 and 39 to facilitate holding the rib assemblies 40 in position, e.g., lock the rib assemblies 40 to the brackets 37, 39 and the hub tower 38. Pin pullers may be released to permit the plurality of rib assemblies 40 to deploy.

Figure 14:
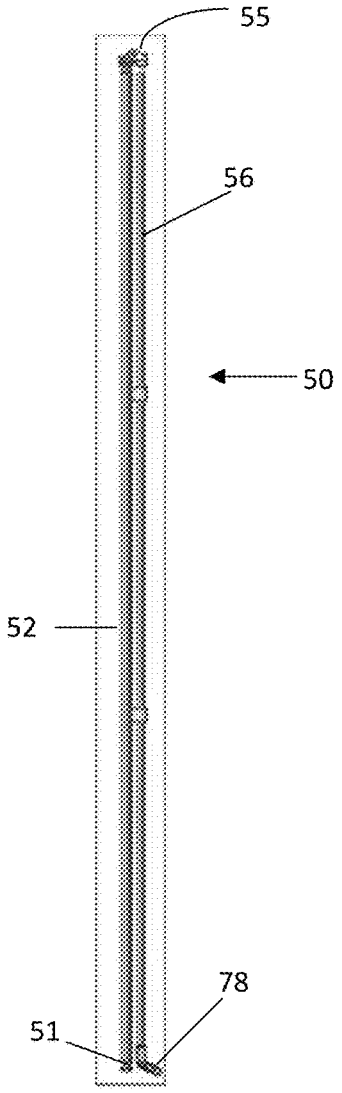
FIG. 14 is a side view of an embodiment of a drive strut assembly in a fully folded or collapsed configuration or position.
Figure 15:
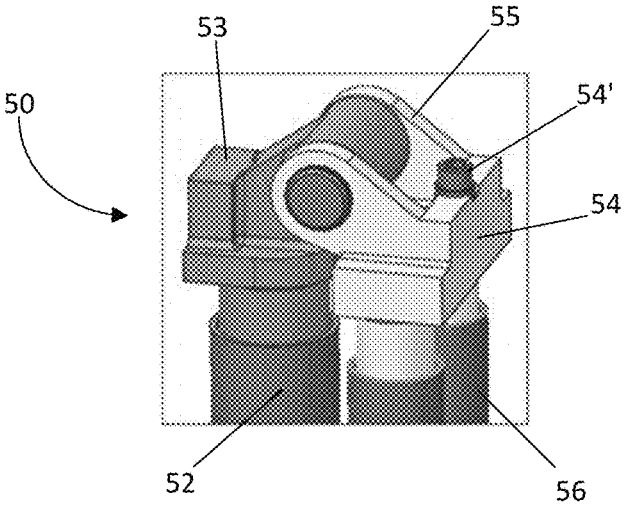
FIG. 15 is a side perspective view of an embodiment of a drive strut hinge in the fully folded or collapsed configuration or position.

The drive strut assembly 50 is illustrated in FIGS. 14-17. FIG. 14 shows the drive strut assembly in the folded condition. The drive strut assembly 50 includes an inner drive strut 52, an outer drive strut 56, and a drive strut hinge assembly 55 that connects inner drive strut 52 to outer drive strut 56, preferably provides an articulating connection that permits inner drive strut 52 to pivot with respect to outer drive strut 56. The drive strut hinge assembly 55 as shown in FIG. 15 includes an inner drive strut fitting 53 and an outer drive strut fitting 54 which are connected by a pin to permit inner drive strut fitting 53 to pivot and rotate with respect to outer drive strut fitting 54. The drive strut hinge 55 preferably permits rotation about one axis, e.g., about an axis through the pin. Although a pin connection is shown for drive strut hinge assembly 55 it will be appreciated that other connection (e.g., hinge) configurations and joints can be utilized.

Figure 16:
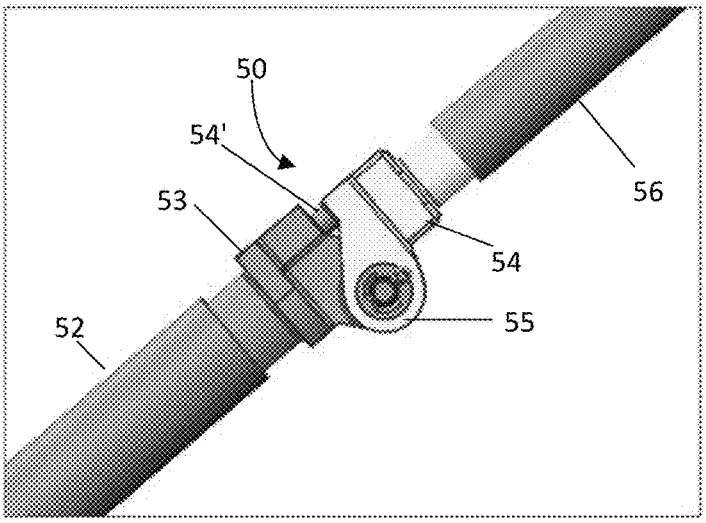
FIG. 16 is a side view of an embodiment of the drive strut in a fully expanded or unfolded configuration or position.

The drive strut hinge assembly 55 permits the inner drive strut 52 to pivot or rotate with respect to outer drive strut 56 so that the drive strut assembly 50 can fold (collapse) and unfold (expand) as shown in FIGS. 14-16. The inner drive strut during expansion of the foldable reflector from the fully collapsed and folded position as shown in FIG. 14 to the fully expanded position as shown in FIG. 16 preferably pivots or rotates approximately 180 degrees. Other ranges of rotation are contemplated depending upon the support structure design and configuration. An optional stop 54' can be provided on outer drive strut fitting 54 that interfaces with inner drive strut fitting 53 to limit motion, i.e., rotation, of the drive strut hinge assembly 55. The optional stop 54' may be adjustable so the amount of rotation of the drive strut hinge can be adjusted.

Figure 17:
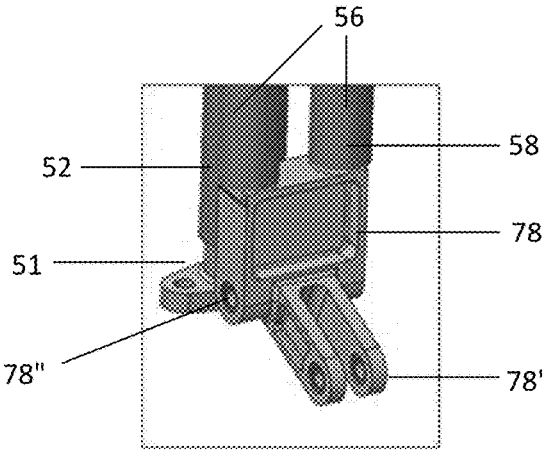
FIG. 17 is a side perspective view of an embodiment of the ends of the drive strut assembly, including a drive strut fitting.

The inner drive strut 52 connects, preferably fixedly connects, to the hub assembly 20, and more specifically connects to the pivot link 25 via connector 51 as shown in FIG. 9. Outer drive strut fitting 78 connects, preferably fixedly connects, to end 58 of the outer drive strut 56 as shown in FIG. 17. Outer drive strut fitting 78 connects to rib assembly 40, and more specifically to rib hinge assembly 60 of the rib assembly 40. Outer drive strut fitting 78 is an angulated member as shown in FIG. 17 and as discussed in more detail below. As illustrated in FIGS. 15 and 17, outer drive strut 56 may comprise a plurality of members, and in the embodiment illustrated comprises two elongated support members where outer drive strut fitting 78 and drive strut hinge assembly 55 are configured and adapted to interface with the two elongated support members. Inner drive strut 52 is shown and illustrated as being a single member (tubular rod), but as can be appreciated by one of ordinary skill in the art, inner drive strut 52 may comprise one or more structural members.

Figure 18:
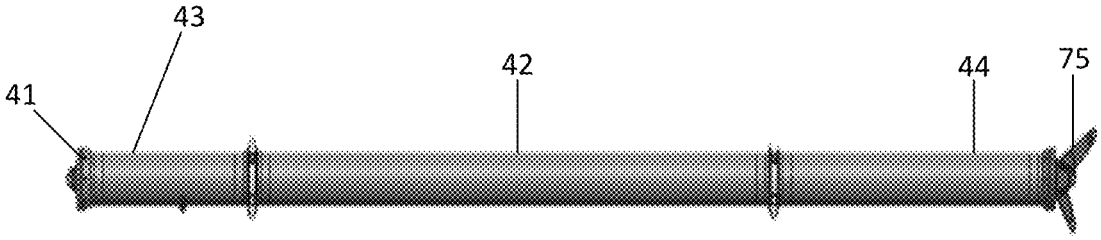
FIG. 18 is a side view of an embodiment of an inner rib of a rib assembly.

Rib assembly 40 shown in FIG. 6 in an embodiment includes inner rib 42, outer rib 46 and a rib hinge assembly 60 connecting inner rib 42 and outer rib 46. Rib hinge assembly 60 discussed in more detail below is a multi-piece hinge that permits inner rib 42 to rotate and pivot with respect to outer rib 46. Inner rib 42 shown in FIG. 18 has a connector 41 at its first end 43 that connects, preferably pivotably connects, the inner rib 42 to the hub tower 38, and more specifically, connects the pivot ring 35 and the connectors 36 on the pivot ring 35 to the inner rib 42. In operation, the inner rib 42 pivots or rotates from a fully folded position as shown in FIGS. 2 and 3 where the inner rib is parallel to the hub tower 38 to a fully expanded position as shown in FIGS. 5 and 6 where the inner rib 42 is approximately ninety degrees (90) with respect to the hub tower 38. In other words, the articulating connection between the connector 41 and the connector 36 of the pivot ring 35 permits the inner rib to rotate or pivot approximately ninety degrees (90). In an embodiment, inner rib connector 41 is connected to connector 36 by a pin such that inner rib 42 rotates with respect to the hub tower about one axis. Other means and joints for connecting inner rib 42 to the hub tower 38 and to pivot ring 35 are contemplated.

The second end 44 of the inner rib 42 has an inner rib hinge fitting 75 that forms part of rib hinge assembly 60 and functions to connect inner rib 42 to outer rib 46. Outer rib 46 shown in FIG. 19 has a connector 62 at its first end 49 that forms part of rib hinge assembly 60 and functions to connect outer rib 46 to inner rib 42. Outer rib 46 and inner rib 42 form rib assembly 40. In operation, inner rib 42 pivots or rotates about 180 degrees with respect to the outer rib 46 from the fully folded position shown in FIGS. 2-3 to the fully expanded position shown in FIGS. 5-6. Rib hinge assembly 60 permits the rotation between inner rib 42 and outer rib 46, preferably in one plane.

Figure 19:
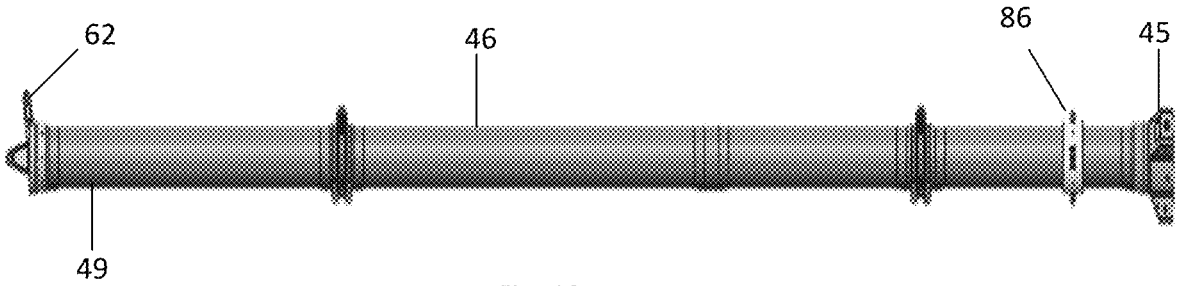
FIG. 19 is a side view of an embodiment of an outer rib of the rib assembly.

In an embodiment, one of the plurality of rib assemblies 40 may have a larger cross sectional size, shown in FIG. 3 as rib assembly 40', to facilitate interaction with a boom element (not shown) that holds the reflector in the correct geometry. It is contemplated that all of the rib assembles 40 may have the same cross-sectional thickness. One or more rib assemblies 40 may have an optional field joint 45 as shown in FIG. 19 to facilitate connecting to the boom assembly to deploy the reflector antenna 5 in space.

Rib hinge assembly 60 connects inner rib 42, outer rib 46 and drive strut assembly 50, more specifically outer drive strut 56. Rib hinge assembly 60 in an embodiment as shown in FIGS. 20-23 can include six support elements and seven articulating joints or connections between the members. The articulating joints may include pins between the connecting elements and may permit rotation in only one plane, however other joints and connection arrangements are contemplated.

Rib hinge assembly 60 in an embodiment, as shown in FIGS. 20-23, includes inner rib hinge fitting 75, hinge frame 70, outer hinge link 65, outer rib hinge fitting 62, inner hinge link 68, and drive strut fitting 78. Inner rib hinge fitting 75 has three articulating connection portions 75', 75", 75'". Frame 70, shown in FIG. 23 has three articulating hinge connection portions 70', 70", 70'", inner hinge link 68 has two articulating hinge portions 68', 68", and outer hinge link 65 has two articulating hinge connection portions 65', 65". Drive strut fitting 78 has two articulating hinge connection portions 78', 78", while outer rib hinge fitting 62 has two articulating hinge connections 62', 62". In other words, the rib hinge assembly 60 includes inner rib fitting 75, outer drive strut fitting 78, outer rib fitting 62 and three intermediate interconnecting members that include frame 70 with three articulating connections, and two linear-shaped, e.g., straight, hinge link members each with two articulating connections.

Turning to the interconnection of the various components of the rib hinge assembly 60, first articulating hinge connection 62' of outer rib hinge fitting 62 connects to hinge frame 70, and more specifically connects to first articulating hinge connection 70', preferably in a manner that permits frame 70 to pivot or rotate with respect to outer rib hinge fitting 62, such as, for example, by use of a pin. Second articulating hinge connector 62" of outer rib hinge fitting 62 connects to outer hinge link 65, and more specifically to a first articulating hinge connection 65' of outer hinge link 65 preferably in a manner that permits outer hinge link 65 to pivot or rotate with respect to outer rib hinge fitting 62, such as for example, by use of a pin.

Outer hinge link 65 has a second articulating hinge connection 65" that connects to inner rib hinge fitting 75, and more specifically connects to a first articulating hinge connection 75' of inner rib hinge fitting 75 preferably in a manner that permits outer link 65 to rotate or pivot with respect to inner rib hinge fitting 75, such as, for example, by use of a pin. Frame 70 has a second articulating hinge connection 70" that connects to inner rib hinge fitting 75, and more specifically connects to second articulating hinge connection 75" of the inner rib hinge 75 preferably in a manner that permits frame 70 to pivot or rotate with respect to inner rib hinge fitting 75, such as, for example, by use of a pin.

Figure 20:
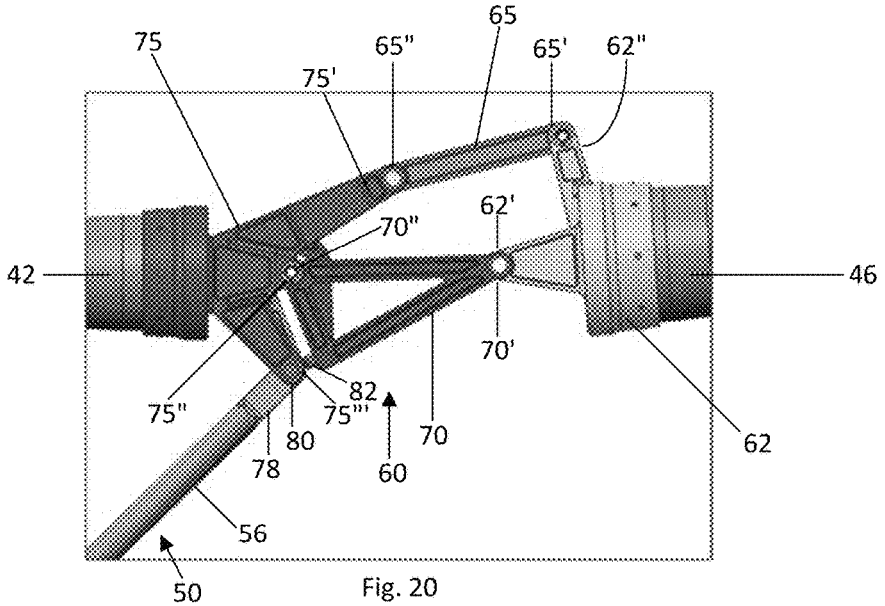
FIG. 20 is a side view of an embodiment of a rib hinge assembly in the fully expanded or unfolded configuration or position.
Figure 21:
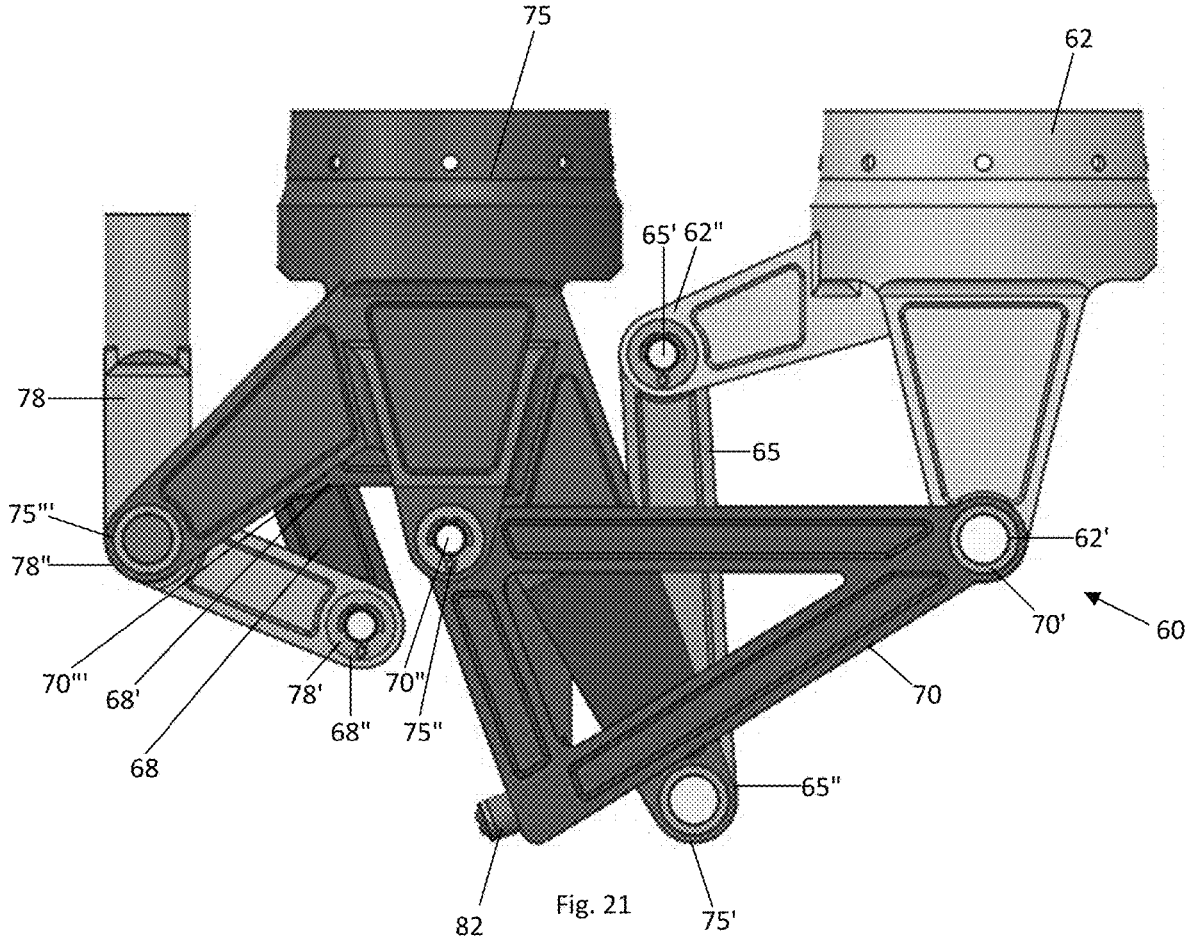
FIG. 21 is a side view of an embodiment of the rib hinge assembly of FIG. 20 in the fully folded or collapsed configuration or position.
Figure 22:
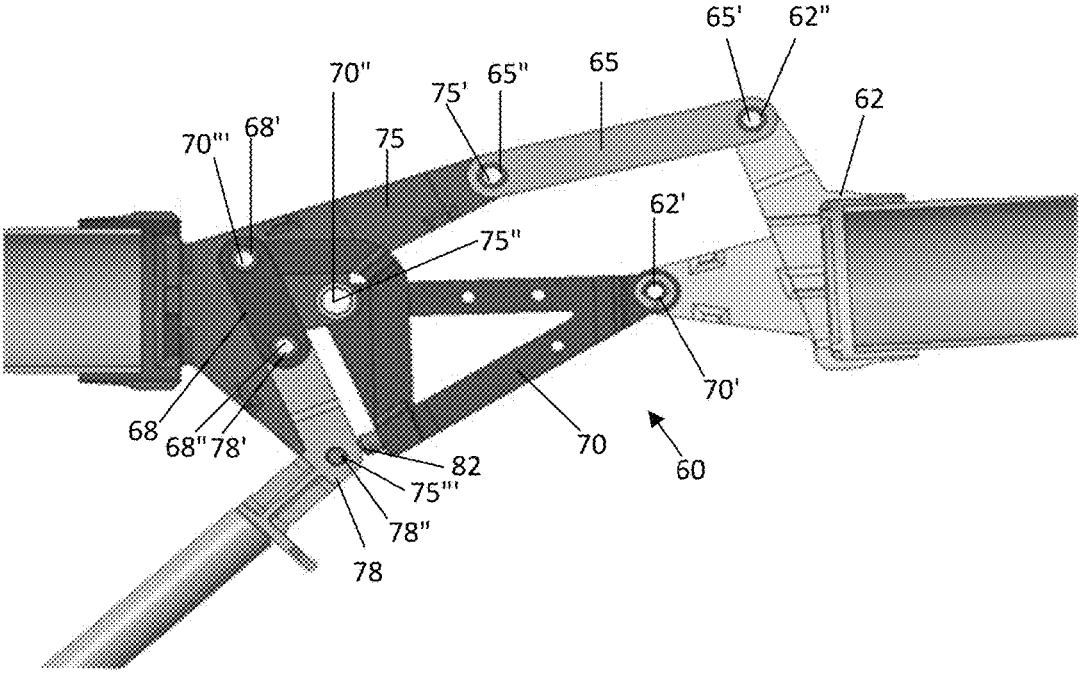
FIG. 22 is a back side view of an embodiment of the rib hinge assembly of FIG. 20 in a partially unfolded or partially expanded configuration or position.
Figure 23:
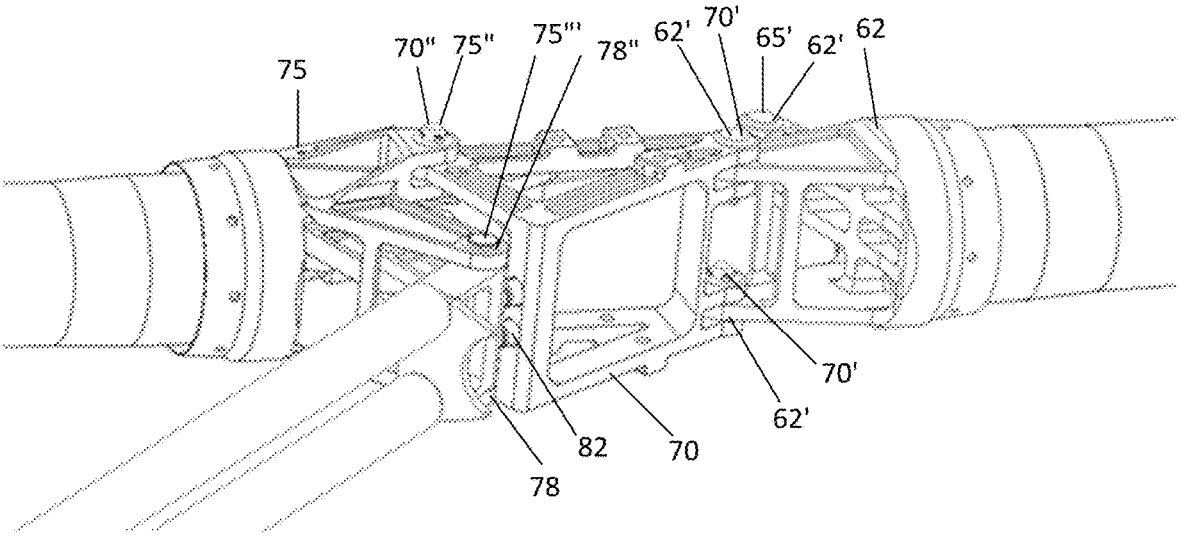
FIG. 23 is a bottom perspective view of an embodiment of the rib hinge assembly.

Frame 70 has a third articulating hinge connection 70'" that connect to inner hinge link 68, and more specifically connects to a first articulating hinge connection 68' of the inner hinge link 68 preferably in a manner that permits inner hinge link 68 to rotate or pivot with respect to frame 70, such as, for example, by use of a pin. Inner hinge link 68 has a second articulating hinge connection 68" that connects to drive strut fitting 78, and more specifically to a first articulating hinge connection 78' of the drive strut fitting 78 preferably in a manner that permits the inner hinge link 68 to rotate or pivot with respect to the drive strut fitting 78, such as, for example, by use of a pin. Inner rib hinge fitting 75 has a third articulating hinge connection 75'" that connects to drive strut fitting 78, more specifically connects to second articulating hinge connection 78" of the drive strut fitting 78 preferably in a manner that permits the drive strut fitting 78 to rotate or pivot with respects to the inner rib hinge fitting 75, such as, for example, by use of a pin. Frame 70 further includes a stop 82 that in the unfolded, fully expanded position contacts with the inner rib hinge fitting 75 as shown in FIG. 20.

In operation, hub assembly 20 applies a force, e.g, a torque or moment, to the drive strut assemblies 50 that moves, e.g., pivots or rotates the inner drive strut 52 with respect to the outer drive strut 56 to apply a force through outer drive strut fitting 78 to hinge assembly 60, which in response unfolds or collapses the rib assembly 40. More specifically, regarding the rib hinge assembly 60 and rib assembly 40, the force applied by the outer drive strut fitting 78 acts upon the inner rib fitting 75 and the inner rib 42 through articulating connections, and acts upon the outer rib fitting 62 and outer rib 46 through articulating connections to expand or collapse the inner rib 42 with respect to the outer rib 46.

Deployable standoff (DPSO) 85, shown in FIGS. 5-6, is a support assembly that holds or stands the reflector off of the rib assembly 40. DPSO 85 is connected to the rib assembly 40 and may rotate or pivot with respect to the rib assembly 40, and more specifically may pivot with respect to the outer rib 46. A cable or cord 87 may extend from the rib assembly 40, more specifically the outer rib 46 via a connector 86, to the DPSO 85. The optional cable or cord 87 extending to DPSO from the rib assembly 40 in an embodiment is part of cable system 90. The DPSO assembly 85 as shown in FIG. 3 may comprise a pair of support members 88 and connector member 89. It is contemplated that DPSO 85 can comprise a single support member, or more than two support members 88.

Figure 24:
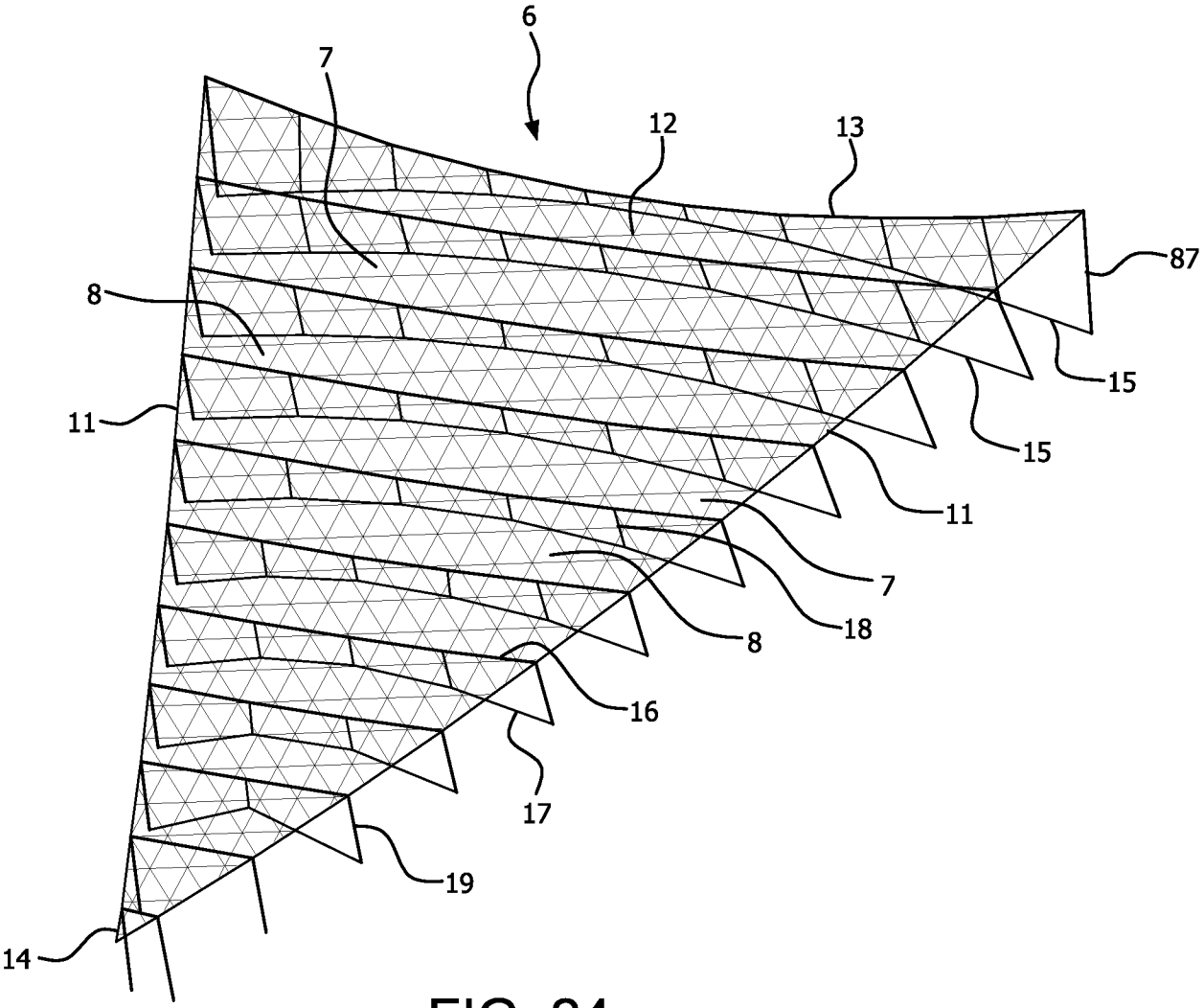
FIG. 24 is a top perspective view of an embodiment of a panel of the reflector structure.

FIG. 24 shows a portion or a panel 6 of reflector 7. Surface 8 of the panel 6 is formed of a mesh material 12, preferably a highly conductive material. Multiple panels 6 may be used to form reflector 7, and in the illustrated embodiment eight (8) panels 6 may be used and supported by support structure 10 to form reflector 7. The panel 6 and the reflector 7 is optionally supported by a series of cables or cords. As shown in FIG. 24, the series of cables and cords supporting and/or restraining the panel 6 of the reflector 7 includes one or more trusses 15. The trusses 15 in an embodiment include one or more front cords 16, one or more rear cords 17, one or more surface ties 18, and one or more edge ties 19. The front cords 16 are connected to the panel 6 and surface ties 18 and edge ties 19 extend downward and connect to the rear cords 17 of the trusses 15.

The rear most or outermost front cord 16 forms the outer edge 13 of the panel 6 and is also referred to as the front outboard intercostal cord. The panel 6 may also include outer strip cords 11 along the side edges and a center patch cord 14. The front cord 16 of the panel closest to the center of the reflector is referred to as the inboard costal, and the center of the panel may have a center patch cord 14. The outer most edge tie 19 may form the DPSO cord 87.

While reflector support structure 10 has been described and illustrated as being constructed of various support elements or members having a circular cross section and being of tubular shape, it will be appreciated that the cross sectional shape and size of the various support members may take other forms and sizes. The support structure or frame 10 may comprise thermoelastically stable graphite composite members, including thermoelastically stable graphite composite drive strut assemblies, rib assemblies, hub tower, and DPSO. Other materials are contemplated for the construction of the various components that make up the support structure.

Reflector support system 10 may further include in an embodiment a cable or cord system 90 that in an embodiment may be configured to restrain expansion of the support structure 10, including restraining the expansion of rib assembly 40 and drive strut assembly 50. An embodiment of optional cable system 90 is shown in FIG. 25. In an aspect optional cable system 90 may include one or more of tower cords 92, hinge cross cords 94, rib tip hoop cords 95, and rib hinge hoop cords 96. Other cords in addition to or as an alternative may be used in the reflector antenna 5.

As shown in FIGS. 6 and 25, tower cords 92 extend from hub assembly 20 to the tip of the rib assembly 40. In more detail, projection pin 91 connects, preferably pivotably connects, to and extends from portion 28 of pivot link 25 as shown in FIG. 9. Tower cord 92 connects to projection pin 91 and extends to the tip of rib assembly 40, more specifically to connector 86 on outer rib 46. Each rib assembly 40 may have a tower cord 92, alternate rib assemblies 40 may have a tower cord 92, or some other arrangement of tower cords 92 may be used. Tower cords 92 have slack when the reflector antenna 5 is in the folded or collapsed configuration (condition), but are taunt when the reflector antenna is in the fully expanded condition and the rib assembly 40 is fully expanded.

Optional cord system 90 may include one or more hinge cross cords 94. Hinge cross cords 94 extend from the end of the rib assembly, more specifically the connector 86 on outer rib 46, to the adjacent rib hinge assembly 60. The outer rib 46 of each rib assembly 40 may have two hinge cross cords 94 extending to the rib hinge assembly 60 on each rib assembly 40. Alternatively, each rib assembly 40 may have only one hinge cross cord 94 extending to one adjacent rib hinge assembly 60. Other configurations for hinge cross cords 94 are contemplated. Hinge cross cords 94 have slack when the reflector antenna 5 is in the folded or collapsed configuration (condition), but are taunt when the reflector antenna is in the fully expanded condition and the rib assembly is fully expanded.

Optional cord system 90 may include one or more rib tip hoop cords 95. Rib tip hoop cords 95 extend from the end of the rib assembly, more specifically the connector 86 on outer rib 46, to the end of the adjacent rib assembly 40, more specifically the connector 86 on the outer rib 46. Each rib assembly 40 preferably has two rib tip hoop cords 95 extending to the connectors 86 on the outer rib 46 on each rib assembly 40. Alternatively, each rib assembly 40 may have only one rib tip hoop cord 95 extending to one adjacent rib assembly 40. Other configurations for rib tip hoop cords 95 are contemplated. Rib tip hoop cords 95 have slack when the reflector antenna 5 is in the folded or collapsed configuration (condition), but are taunt when the reflector antenna is in the fully expanded condition and the rib assembly is fully expanded.

Optional cord system 90 may include one or more rib hinge hoop cords 96. Rib hinge hoop cords 96 extend from the rib hinge assembly 60 of a rib assembly 40 to an adjacent rib hinge assembly 60 of an adjacent rib assembly 40. Each rib assembly 40 preferably has two rib hinge hoop cords 96 extending to each adjacent rib hinge assembly 60 on each adjacent rib assembly 40. Alternatively, each rib assembly 40 may have only one rib hinge hoop cord 96 extending to one adjacent rib hinge assembly 60. Other configurations for rib hinge hoop cords 96 are contemplated. Rib hinge hoop cords 96 have slack when the reflector antenna 5 is in the folded or collapsed configuration (condition), but are taunt when the reflector antenna is in the fully expanded condition and the rib assembly is fully expanded.

The support structure 10 permits, facilitates and provides a compact folded configuration for the reflector antenna 5 and also permits, facilitates and provides for controlled expansion of the reflector in a manner that provides no over stretch or undue strain on the support structure, and permits the reflector to unfold in a highly reliable and accurate manner. In operation, according to the illustrated embodiment, carrier 24 moves laterally about 1.5 inches along screw 22 to pivot end 25" of the pivot link 25 about forty-five degrees (45), which unfolds and rotates inner drive strut 52 about 180 degrees with respect to outer drive strut 56, which rotates the inner rib 42 about ninety degrees (90) with respect to the hub tower 38 and rotates the outer rib 46 about 180 degrees with respect to the inner rib 42. Other travel distances for carrier 24 are contemplated in order to get the desired torque and angulation (rotation) of the pivot link and drive strut assembly 50. Hub assembly 20 may take other configurations and sizes to obtain the desired torque and angulation to the drive strut assembly 50. In addition, other rotational ranges are contemplated for drive strut assembly 50 and rib assembly 40. Other configurations, sizes, shapes, and arrangements for the rib assembly 60, and its various elements, and interconnections are also contemplated.

Figure 26:
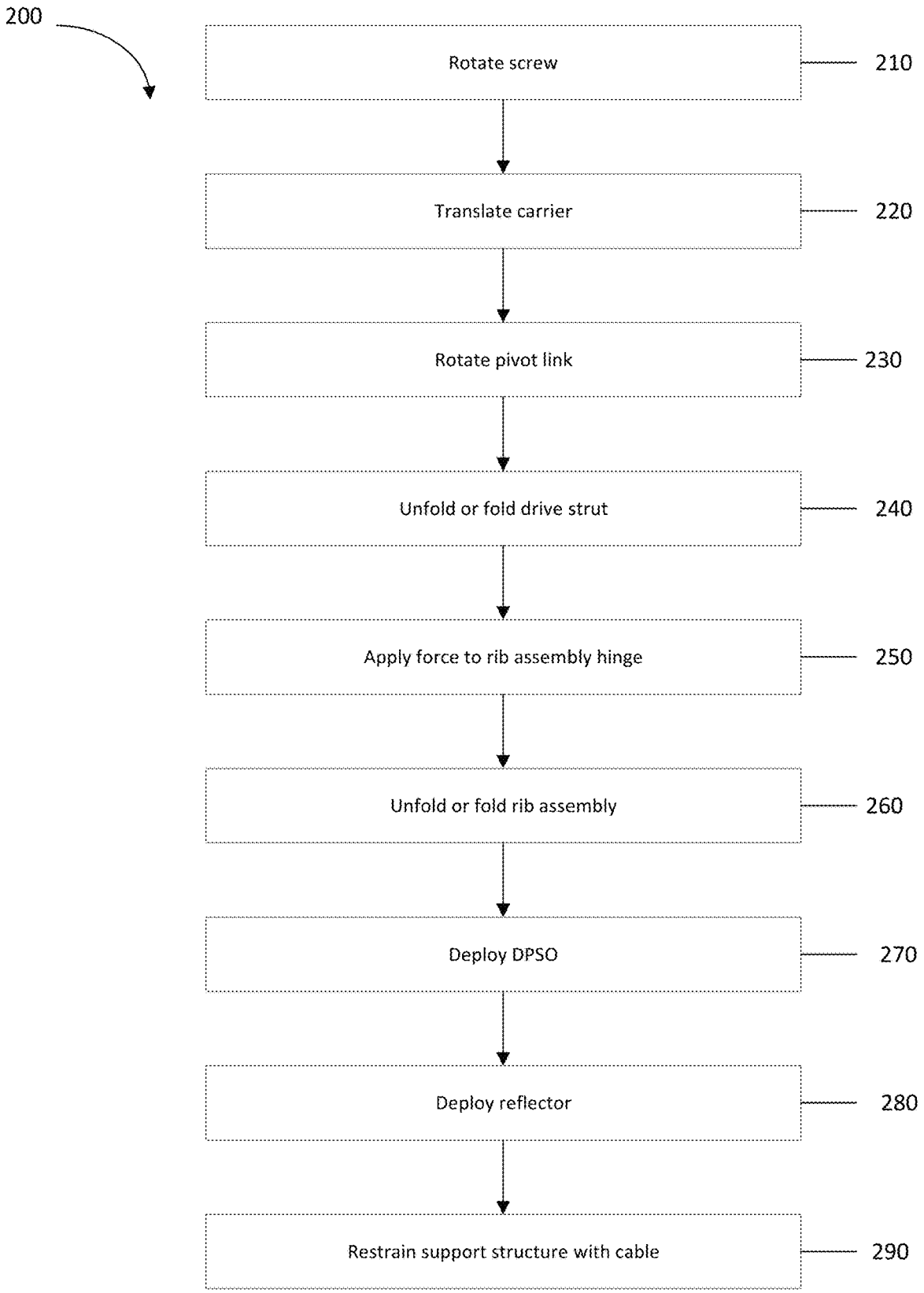
FIG. 26 is a flow diagram of a method of deploying or collapsing a reflector antenna.

FIG. 26 is an exemplary flowchart in accordance with one embodiment illustrating and describing a method of operating a foldable reflector in accordance with an embodiment of the present disclosure. While method 200 is described for the sake of convenience and not with an intent of limiting the disclosure as comprising a series and/or a number of steps, it is to be understood that the process does not need to be performed as a series of steps and/or the steps do not need to be performed in the order shown and described with respect to FIG. 26, but the process may be integrated and/or one or more steps may be performed together, simultaneously, or the steps may be performed in the order disclosed or in an alternate order. In this regard, each block in the flowchart or block diagrams may represent a module, segment, or portion of a process, which comprises one or more steps for implementing the specified function(s).

Accordingly, blocks of the flowchart illustration support combinations of means for performing the specified functions, and/or combinations of steps for performing the specified functions. It will also be understood that each block of the flowchart illustration, and combinations of blocks in the flowchart illustration, can be implemented by the disclosed embodiments and equivalents thereof, including future developed equivalents.

According to one embodiment of a method 200 of expanding (e.g., deploying) or collapsing (e.g., folding) a reflector antenna, at 210 a screw is rotated, for example in a hub assembly. Rotation of the screw, at 220 translates a carrier, preferably along the screw. Translation of the carrier, at 230 rotates or pivots a pivot link, preferably in an embodiment about 45 degrees. Rotation of the pivot link, at 240 unfolds or folds a drive strut assembly, e.g. preferably rotates an inner drive strut with respect to an outer drive strut. The inner drive strut rotates with respect to the outer drive strut an angular range that in an embodiment is preferably about 180 degrees. At 250, unfolding the drive strut assembly applies a force to the rib assembly, preferably through a rib hinge assembly in the middle region of the drive rib assembly. Applying force to the rib assembly at 260 unfolds or folds the rib assembly, preferably unfolds an inner rib with respect to an outer rib an angular range that in an embodiment is preferably about 180 degrees. Unfolding or folding the rib assembly, at 280 deploys the reflector. In an embodiment, unfolding the rib assembly at 270 deploys the DPSO to hold the reflector off the rib assembly. In an embodiment, at 290 the support structure may optionally be restrained by a cable system.

Those skilled in the art will recognize that the reflector has many applications, may be implemented in various manners and, as such is not to be limited by the foregoing embodiments and examples. Any number of the features of the different embodiments described herein may be combined into a single embodiment. The support structure may be varied and the locations and positions of particular elements, for example, may be altered. Alternate embodiments are possible that have features in addition to those described herein or may have less than all the features described. Functionality may also be, in whole or in part, distributed among multiple components, in manners now known or to become known.

It will be appreciated by those skilled in the art that changes could be made to the embodiments described above without departing from the broad inventive concept. It is understood, therefore, that this invention is not limited to the particular embodiments disclosed, but it is intended to cover modifications within the spirit and scope of the invention. While fundamental features have been shown and described in exemplary embodiments, it will be understood that omissions, substitutions, and changes in the form and details of the disclosed embodiments of the reflector may be made by those skilled in the art without departing from the spirit of the invention. Moreover, the scope of the invention covers conventionally known, and future-developed variations and modifications to the components described herein as would be understood by those skilled in the art.

Furthermore, although individually listed, a plurality of means, elements, or method steps may be implemented by, e.g., a single unit, element, or piece. Additionally, although individual features may be included in different claims, these may advantageously be combined, and their inclusion individually in different claims does not imply that a combination of features is not feasible and/or advantageous. In addition, singular references do not exclude a plurality. The terms "a", "an", "first", "second", etc., do not exclude a plurality. Reference signs or characters in the disclosure and/or claims are provided merely as a clarifying example and shall not be construed as limiting the scope of the claims in any way.

Accordingly, while illustrative embodiments of the disclosure have been described in detail herein, it is to be understood that the inventive concepts may be otherwise variously embodied and employed, and that the appended claims are intended to be construed to include such variations, except as limited by the prior art.

The invention claimed is:

1. A foldable and expandable antenna reflector support structure to support an expandable generally dish shaped reflector, the reflector support structure comprising:

a hub assembly to provide a force to the support structure;

a hub tower extending from the hub assembly;

a plurality of drive strut assemblies, each drive strut assembly having an inner drive strut, an outer drive strut and a strut hinge assembly so that the inner drive strut can pivot with respect to the outer drive strut so that each drive strut assembly can fold or expand, and at least one drive strut assembly is connected to the hub assembly and is configurable to receive a force from the hub assembly; and a plurality of rib assemblies, each rib assembly having an inner rib, an outer rib, and a multi-piece rib hinge assembly so that the inner rib can pivot with respect to the outer rib, and each inner rib is pivotably connected to the hub tower, wherein the support structure has a first folded configuration and a second expanded configuration and each drive strut assembly is pivotably connected to one of the rib assemblies and is configured to apply a force to that rib assembly to rotate the outer rib with respect to the inner rib in response to the hub assembly applying the force to the at least one of the drive strut assemblies to thereby fold or expand the reflector support structure from the first folded configuration to the second expanded configuration.

2. The reflector support structure according to claim 1, wherein the inner drive strut rotates approximately 180 degrees with respect to the outer drive strut and in response the outer rib rotates approximately 180 degrees with respect to the inner rib.

3. The reflector support structure according to claim 1, wherein the rib hinge assembly comprises an inner rib fitting, an outer rib fitting and an outer drive strut fitting.

4. The reflector support structure according to claim 3, wherein the outer drive strut fitting has a plurality of articulating connections.

5. The reflector support structure according to claim 3, wherein the inner rib fitting has three articulation connections.

6. The reflector support structure according to claim 3, wherein the outer rib fitting has two articulating connections.

7. The reflector support structure according to claim 3, wherein the rib hinge assembly includes additional intermediate elements and the outer drive strut fitting connects to the inner rib fitting and the additional intermediate elements.

8. The reflector support structure according to claim 7, wherein the additional intermediate elements include three structural elements.

9. The reflector support structure according to claim 7, wherein the additional intermediate members includes a frame with three articulating connections.

10. The reflector support structure according to claim 9, wherein the additional intermediate members includes two linear link elements each with two articulating connections.

11. The reflector support structure according to claim 1, wherein the rib hinge assembly includes six components with seven articulating connections.

12. The reflector support structure according to claim 1, wherein the support structure further includes at least one deployable standoff.

13. The reflector support structure according to claim 1, wherein the support structure further includes a cable system to restrain the reflector support structure.

14. The reflector support structure according to claim 1, wherein the hub assembly includes a carrier, a pull rod and a pivot link.

15. The reflector support structure according to claim 14, wherein the hub assembly includes a screw, and a motor for rotating the screw.

16. An antenna reflector system comprising:

a reflector;

a support structure comprising:

a multi-component hub assembly configured to provide a force to the support structure;

a hub tower extending from the hub assembly and including a pivot ring;

a plurality of drive strut assemblies, each drive strut assembly comprising an inner drive strut, a drive strut hinge assembly, and an outer drive strut, wherein the inner drive strut is pivotably connected to the outer drive strut by the drive strut hinge assembly, and each inner drive strut is connected to the hub assembly; and a plurality of rib assemblies, each rib assembly including an inner rib, an outer rib, and a rib hinge assembly, wherein the inner rib of each rib assembly is pivotably connected to the pivot ring and each rib hinge assembly comprises multiple pieces and the rib hinge assembly has seven articulating connections;

wherein the hub assembly rotates the inner drive strut which in response rotates the outer drive strut which in response applies a force to the rib hinge assembly which in response rotates the outer rib with respect to the inner rib which expands or collapses the support structure and the reflector.

17. The antenna reflector of claim 16, wherein the reflector comprises a mesh formed of conductive filaments with openings.

18. The antenna reflector of claim 16, wherein the rib hinge assembly comprises an inner rib fitting at the end of the inner rib having three articulating connections, an outer rib fitting at the end of the outer rib having two articulating connections, and an outer drive strut fitting at the end of the outer drive strut having two articulating connections, wherein at least one of the articulating connections of the outer drive strut fitting is connected to at least one of the articulating connections of the inner rib fitting.

19. The antenna reflector of claim 18, wherein the rib hinge assembly further includes a frame having three articulating connections, and two hinge links each having two articulating connections, wherein the frame has one articulating connection connected to the inner rib fitting and one articulating connection connected to the outer rib fitting.

20. The antenna reflector system of claim 19, wherein one of the hinge links is connected to both the outer rib fitting and the inner rib fitting, and the other of the hinge links is connected to both the frame and the outer drive strut fitting.

21. The antenna reflector of claim 16, further comprising a cable system to restrain expansion of the support structure.

22. The antenna reflector of claim 21, wherein the cable system comprises a tower cord that extends from the hub assembly to the outer rib.

23. The antenna reflector of claim 22, wherein the cable system further comprises a cable that extends from the outer rib of a first rib assembly to the hinge assembly of a second adjacent rib assembly.

24. The antenna reflector of claim 23, wherein the cable system further comprises a plurality of hinge hoop cables wherein each hinge hoop cable extends from the rib assembly to each adjacent rib assembly.

25. An antenna reflector system comprising:

a mesh reflector;

a support structure comprising:

a hub assembly comprising a rotatable screw, a carrier mounted on and translatable with respect to the screw, a plurality of pull rods pivotably connected to the carrier, each pull rod pivotably connected to a pivot link;

a hub tower extending from the hub assembly and including a pivot ring;

a plurality of drive strut assemblies, each drive strut assembly comprising an inner drive strut, a drive strut hinge assembly, and an outer drive strut, wherein the inner drive strut is pivotably connected to the outer drive strut by the drive strut hinge assembly, and each inner drive strut is connected to the pivot link of the hub assembly; and a plurality of rib assemblies, each rib assembly including an inner rib, an outer rib, and a rib hinge assembly, wherein the each rib hinge assembly comprises multiple pieces and the rib hinge assembly has seven articulating connections, wherein the inner rib of each rib assembly is pivotably connected to the pivot ring and the rib hinge assembly includes an outer drive strut fitting connected to the outer drive strut, with the outer drive strut fitting having two of the articulating connections, and wherein the pivot link of the hub assembly rotates the inner drive strut which in response rotates the outer drive strut which in response applies a force to the rib hinge assembly which in response rotates the outer rib with respect to the inner rib which expands or collapses the antenna reflector.

* * * * *